US010215497B2

(12) United States Patent
Noishiki et al.

(10) Patent No.: US 10,215,497 B2
(45) Date of Patent: Feb. 26, 2019

(54) HEAT EXCHANGER AND PRODUCTION METHOD FOR HEAT EXCHANGER

(71) Applicant: KOBE STEEL, LTD., Kobe-shi (JP)

(72) Inventors: Koji Noishiki, Takasago (JP); Yohei Kubo, Kobe (JP); Sayaka Yamada, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 151 days.

(21) Appl. No.: 15/035,418

(22) PCT Filed: Dec. 3, 2014

(86) PCT No.: PCT/JP2014/081947

§ 371 (c)(1),
(2) Date: May 9, 2016

(87) PCT Pub. No.: WO2015/083728

PCT Pub. Date: Jun. 11, 2015

(65) Prior Publication Data

US 2016/0290733 A1 Oct. 6, 2016

(30) Foreign Application Priority Data

Dec. 5, 2013 (JP) ..... 2013-252272

(51) Int. Cl.
*F28D 9/00* (2006.01)
*F28F 3/08* (2006.01)
(Continued)

(52) U.S. Cl.
CPC ..... *F28D 9/0068* (2013.01); *F28D 9/0037* (2013.01); *F28D 9/0062* (2013.01);
(Continued)

(58) Field of Classification Search
CPC .... F28D 9/0068; F28D 9/0031; F28D 9/0037; F28D 9/0062; F28D 9/0075; F28F 3/086;
(Continued)

(56) References Cited

U.S. PATENT DOCUMENTS 3,258,832 A * 7/1966 Gerstung ..... B21D 53/04 165/148
4,624,305 A * 11/1986 Rojey ..... F28F 3/086 165/165
(Continued)

FOREIGN PATENT DOCUMENTS

EP 0 357 605 B1 3/1990
GB 357605 9/1931
(Continued)

OTHER PUBLICATIONS

International Search Report dated Mar. 3, 2015, in PCT/JP2014/081947 filed Dec. 3, 2014.

*Primary Examiner* — Jon T. Schermerhorn, Jr.
(74) *Attorney, Agent, or Firm* — Oblon, McClelland, Maier & Neustadt, L.L.P.

(57) ABSTRACT

A heat exchanger including a stacking block, including: a first plate surface; a second plate surface opposite to the first plate surface; and first and second flow path plates including respective plural first and second through holes that have a standard shape. The first through holes are arranged to line up in a standard array pattern in a first direction in which a first flow path causes a first fluid to flow. The second through holes are arranged in the first direction in the same standard array pattern as the first through holes. Each of the first through holes have an area with a same overlap with the second through holes positioned on both sides of the first through holes, in the first direction. The first flow path is formed by the first and second through holes being mutually joined in the first direction, in the areas of overlap.

7 Claims, 8 Drawing Sheets

(51) Int. Cl.
*F28F 9/02* (2006.01)
*F28F 13/06* (2006.01)
*F28F 13/12* (2006.01)

(52) U.S. Cl.
CPC ..... *F28D 9/0075* (2013.01); *F28F 3/08* (2013.01); *F28F 3/086* (2013.01); *F28F 9/0204* (2013.01); *F28F 9/0214* (2013.01); *F28F 13/06* (2013.01); *F28F 13/12* (2013.01)

(58) Field of Classification Search
CPC ..... F28F 3/08; F28F 9/0204; F28F 9/0214; F28F 13/06; F28F 13/12
See application file for complete search history.

(56) References Cited

U.S. PATENT DOCUMENTS 4,762,172 A * 8/1988 Grehier ..... F28F 3/086 165/165
5,193,611 A * 3/1993 Hesselgreaves ..... F28F 3/02 165/165
2003/0000687 A1* 1/2003 Mathur ..... F28D 9/0037 165/166
2004/0182556 A1* 9/2004 Jahn ..... B01J 19/249 165/166
2011/0268616 A1* 11/2011 Noishiki ..... B01J 19/0093 422/129
2012/0138266 A1* 6/2012 Yamada ..... F28D 9/0006 165/104.11
2012/0208265 A1* 8/2012 Partsch ..... B01F 5/0604 435/289.1
2013/0105128 A1* 5/2013 Vanderwees ..... F28D 9/005 165/165

FOREIGN PATENT DOCUMENTS

JP 2-21519 B2 5/1990
JP 03-128270 U 12/1991
JP 3-128270 U 12/1991
JP 2862213 B2 3/1999
JP 2009-36498 A 2/2009
WO WO 98/55812 A1 12/1998

* cited by examiner

X
Y
37b
37b
37a
20(2)
14
22(2)
37b
37a
10
V
V
37
37
37

HEAT EXCHANGER AND PRODUCTION METHOD FOR HEAT EXCHANGER

TECHNICAL FIELD

The present invention relates to a heat exchanger and a production method of the heat exchanger.

BACKGROUND ART

Conventionally, a stacked heat exchanger whose flow paths are formed by stacking a plurality of plates formed with a plurality of through holes respectively and communicating the through holes of the respective plates is known. In the following Patent Document 1, one such example of the stacked heat exchanger is shown.

In the heat exchanger disclosed in the following Patent Document 1, the respective stacked plates constituting the heat exchanger are formed with a lot of through holes respectively. The lot of through holes formed in the respective plates include elongated holes extending linearly, elongated holes bent at a right angle, and elongated holes bent in a dogleg shape, or the like. The lot of through holes formed in the respective plates are arranged so as to line up along a predetermined direction respectively, and the arrangement directions of the through holes in the two plates stacked to each other are directions corresponding to each other. Then, the through holes formed in the two stacked plates are communicated to each other in their arrangement directions, thereby flow paths that allow a fluid as an object of heat exchange to flow are formed.

However, in the conventional heat exchanger, a plurality of through holes having different shapes are formed in the respective plates, and those through holes are formed in a state that different arrangement patterns are intermingled, therefore there is a problem that the internal structure of the heat exchanger is complicated and the production cost of the heat exchanger increases.

CITATION LIST

Patent Document

Patent Document 1: WO 98/55812

SUMMARY OF THE INVENTION

An object of the present invention is to simplify the internal structure of the stacked heat exchanger and to reduce the production cost of the heat exchanger.

A heat exchanger according to one aspect of the present invention is a heat exchanger that allows at least a first fluid and a second fluid to exchange heat therebetween while allowing those fluids to circulate, the heat exchanger being provided with a stacking block having therein a first flow path that allows the first fluid to circulate and a second flow path that allows the second fluid to circulate, in which the stacking block has: a first plate surface being a plate surface on one side; a second plate surface being a plate surface on the opposite side to the first plate surface; a first flow path plate formed with a plurality of first through holes having a constant shape; a second flow path plate formed with a plurality of second through holes having the same constant shape as the first through holes; a first seal plate stacked on the second plate surface; and a second seal plate stacked on a plate surface of the second flow path plate on the opposite side to the first flow path plate, in the first flow path plate, the first through holes are arranged so as to line up in a constant arrangement pattern in a first direction in which the first flow path allows the first fluid to flow, in the second flow path plate, the second through holes are arranged so as to line up in the first direction in the same constant arrangement pattern as the first through holes, and each of the first through holes has regions overlapping with the second through holes located on both sides of the first through hole in the first direction, and the first flow path is formed by the first through holes and the second through holes being alternately connected in the first direction in the regions where those through holes overlap.

A production method of a heat exchanger according to another aspect of the present invention is a method for producing a heat exchanger that allows at least a first fluid and a second fluid to exchange heat therebetween while allowing those fluids to circulate, the method being provided with a stacking block forming step for forming a stacking block having therein a first flow path that allows the first fluid to circulate and a second flow path that allows the second fluid to flow circulate, in which the stacking block forming step includes a first flow path forming step for forming the first flow path in the stacking block, and a second flow path forming step for forming the second flow path in the stacking block, the first flow path forming step has: a first through hole forming step for forming a plurality of first through holes having a constant shape in a first flow path plate so as to line up in a constant arrangement pattern in a first direction in which the first flow path allows the first fluid to flow; a second through hole forming step for forming a plurality of second through holes having the same constant shape as the first through holes in a second flow path plate so as to line up in the same constant arrangement pattern as the arrangement pattern of the first through holes; and a first stacking step for stacking the second flow path plate to the first flow path plate, and for stacking a first seal plate to a plate surface of the first flow path plate on the opposite side to the second flow path plate so as to seal the openings of the plurality of first through holes formed in the plate surface, and stacking a second seal plate to a plate surface of the second flow path plate on the opposite side to the first flow path plate so as to seal the openings of the plurality of second through holes formed in the plate surface, and in the first stacking step, the second flow path plate is stacked to the first flow path plate so that each of the first through holes partially overlaps with the second through holes located on both sides of the first through holes in the first direction, and the first flow path is formed by the first through holes and the second through holes being alternately connected in the first direction in the regions where those through holes overlap.

DESCRIPTION OF EMBODIMENTS

Hereinafter, embodiments of the present invention will be described with reference to the drawings.

Figure 1:
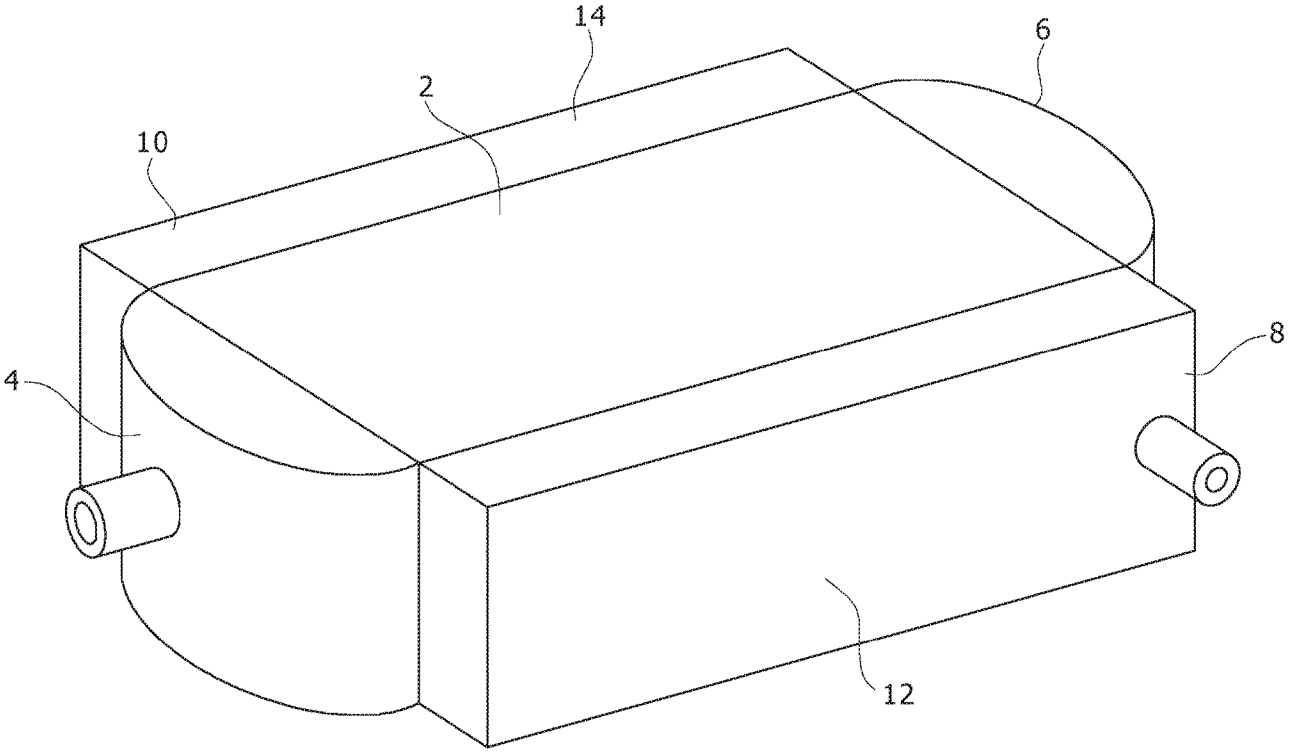
FIG. 1 is a perspective view showing an overall configuration of a heat exchanger according to an embodiment of the present invention.

A heat exchanger according to an embodiment of the present invention allows a first fluid and a second fluid to exchange heat therebetween while allowing those fluids to circulate. For example, the heat exchanger of the present embodiment is used for cooling of hot oil with a cooling water, cooling of the gas compressed by a compressor with a cooling water, and the like. As shown in FIG. 1, the heat exchanger of the present embodiment is provided with a stacking block 2, a first supply header 4, a first discharge header 6, a second supply header 8, a second discharge header 10, a one side circulation header 12, and an other side circulation header 14.

The stacking block 2 is formed by a plurality of first flow path plates 16 (see FIG. 4), a plurality of second flow path plates 18, a plurality of third flow path plates 20, a plurality of fourth flow path plates 22, a plurality of first seal plates 24, a plurality of second seal plates 26, and a plurality of third seal plates 28 being stacked and diffusion-bonded together. Each of these plates 16, 18, 20, 22, 24, 26, and 28 is a rectangular flat plate formed of metal such as stainless steel. It should be noted that the stacking block 2 is a multilayered structure having a plurality of unit stacking structures consist of the respective plates 18, 20, 22, 24, 26, and 28 shown in FIG. 4 and FIG. 5. That is, the unit stacking structure is formed by the first seal plate 24, the first flow path plate 16, the second flow path plate 18, the second seal plate 26, the third flow path plate 20, the fourth flow path plate 22, and the third seal plate 28 being stacked in this order. Then, the multilayered structure of the stacking block 2 is formed by stacking the unit stacking structures in the number in accordance with the throughput of fluids handled by the heat exchanger. The stacking block 2 has therein a first flow path 33 that allows the first fluid to circulate and a second flow path that allows the second fluid to circulate.

Figure 2:
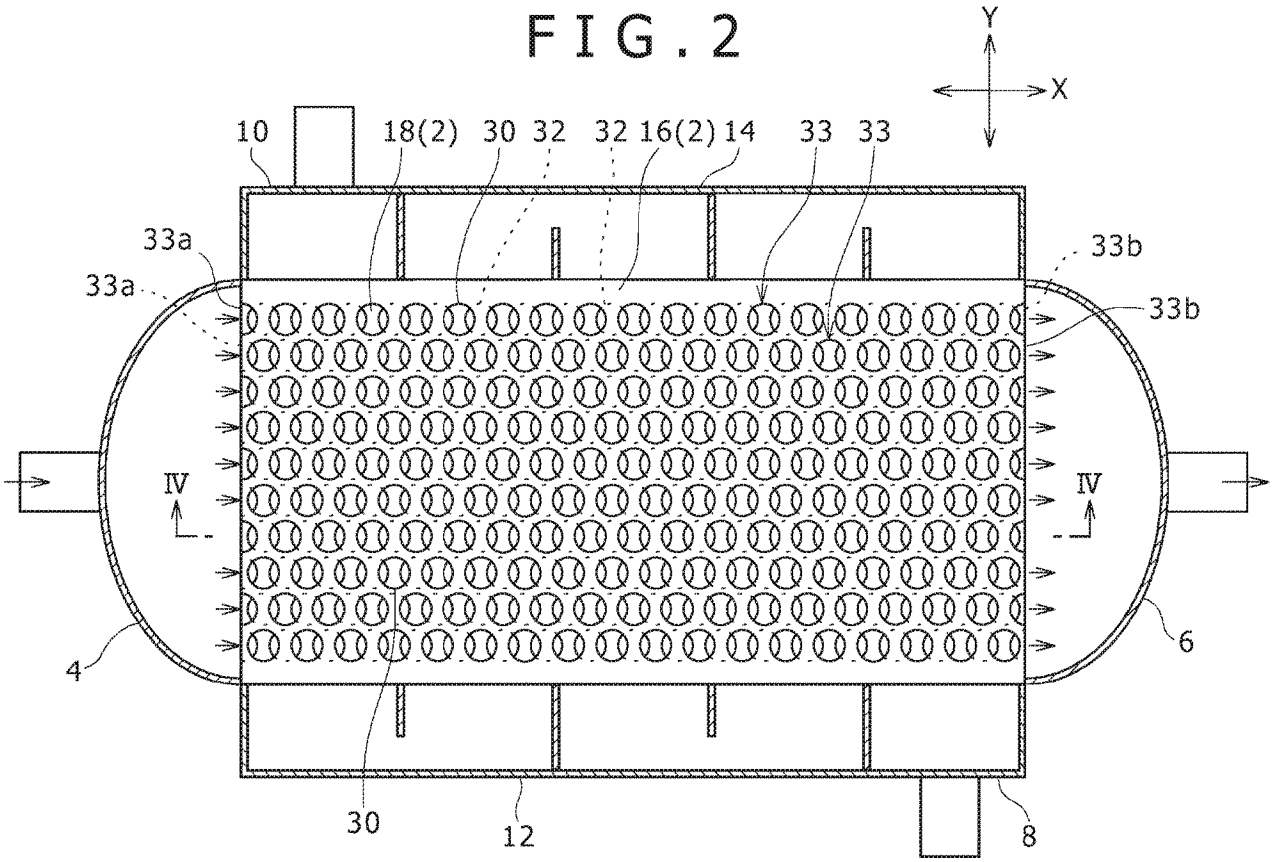
FIG. 2 is a view showing an internal structure of the heat exchanger shown in FIG. 1 and showing a cross section of the boundary part between a first flow path plate and a first seal plate.

Each of the first flow path plates 16 is a rectangular plate body. Each of the first flow path plates 16 has a first plate surface **16*a* being a plate surface on one side in the thickness direction, and a second plate surface 16*b* being a plate surface on the opposite side to the first plate surface 16*a*. In each of the first flow path plates 16, a plurality of first through holes 30 are formed so as to pass through the first flow path plate 16 in the thickness direction. The respective first through holes 30 are formed in the same constant shape. Concretely, each of the first through holes 30 is formed in a precise circular through hole of the same diameter. Moreover, as shown in FIG. 2, the plurality of first through holes 30 formed in each of the first flow path plates 16 line up along a plurality of first lines extending in the direction along the long side of the first flow path plate 16. Here, the direction in which the first through holes 30 of each of the first lines line up is assumed to an X-direction, and the direction orthogonal to both the X-direction and the stacking direction of the respective plates is assumed to a Y-direction. It should be noted that the X-direction is an example of "a first direction" of the present invention and is a direction in which the first flow path 33 allows the first fluid to circulate. The plurality of first lines are arranged in parallel in the Y-direction and arranged parallel to each other. In each of the first flow path plates 16, the first through holes 30 line up in a constant arrangement pattern in the X-direction. In each of the first lines, the first through holes 30 line up at equal intervals in the X-direction. The first through holes 30 of the first lines adjacent to each other in the Y-direction are arranged with a deviation to each other in the X-direction. Concretely, the first through holes 30 of the first lines adjacent to each other in the Y-direction are arranged so as to mutually have a deviation in the X-direction corresponding to half of the interval between the centers of the first through holes 30** lined up in the X-direction.

Each of the second flow path plates 18 (see FIG. 4) consists of a plate body having the same outer shape as the outer shape of the first flow path plate 16. Each of the second flow path plates 18 is stacked on the first plate surface **16*a* of the corresponding first flow path plate 16. In each of the second flow path plates 18, a plurality of second through holes 32 are formed so as to pass through the second flow path plate 18 in the thickness direction. The respective second through holes 32 are formed in the same constant shape as the first through holes 30. All the second through holes 32 formed in each of the second flow path plates 18 line up in the same constant arrangement pattern as the arrangement pattern of the first through holes 30 in the X-direction. Concretely, as shown in FIG. 2, the plurality of second through holes 32 in each of the second flow path plates 18 extend in the X-direction and line up along a plurality of second lines corresponding to the plurality of first lines of the first through holes 30 formed in the first flow path plate 16. The plurality of second lines are arranged in parallel in the Y-direction and arranged parallel to each other. In each of the second lines, the second through holes 32 line up at equal intervals in the X-direction. The arrangement interval of the second through holes 32 in each of the second lines is same as the arrangement interval of the first through holes 30. Moreover, the second through holes 32 of the second lines adjacent to each other in the Y-direction are arranged with a deviation to each other in the X-direction. Concretely, the second through holes 32 of the second lines adjacent to each other in the Y-direction are arranged so as to mutually have a deviation in the X-direction corresponding to half of the interval between the centers of the second through holes 32** lined up in the X-direction.

Then, the first through holes 30 of each of the first lines and the second through holes 32 of the corresponding second line are arranged so as to overlap with a deviation to each other in the X-direction. In other words, each of the first through holes 30 has regions overlapping respectively with the respective second through holes 32 located on both sides of the first through hole 30 in the X-direction.

The deviation in the X-direction between the first through hole 30 and the second through hole 32 overlapped with each other corresponds to half of the interval between the centers of the first through holes 30 lined up in the X-direction. In this way, the first through holes 30 of the first line and the second through holes 32 of the corresponding second line are overlapped with each other with a deviation in the X-direction, and thereby the first through holes 30 of the first line and the second through holes 32 of the corresponding second line are alternately connected in the X-direction in the regions where those through holes overlap.

Figure 4:
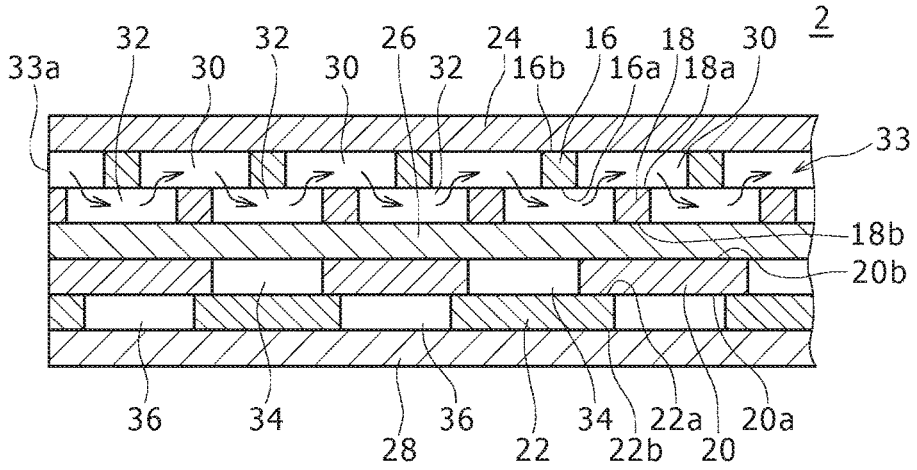
FIG. 4 is a view partially showing a cross section taken along the line IV-IV in FIG. 2 of a stacking block constituting the heat exchanger.

The first seal plate 24 is stacked on the second plate surface 16*b* of the first flow path plate 16 on the opposite side to the second flow path plate 18. Moreover, the second seal plate 26 is stacked on a plate surface 18*b* of the second flow path plate 18 on the opposite side to the first flow path plate 16. The openings of the respective first through holes 30 formed in the second plate surface 16*b* of the first flow path plate 16 are sealed by the first seal plate 24, and the openings of the respective second through holes 32 formed in the plate surface 18*b* of the second flow path plate 18 on the opposite side to the first flow path plate 16 are sealed by the second seal plate 26, and thereby the first flow path 33 meandering in the stacking direction of the plates as shown in FIG. 4 is formed. Within the stacking block 2, a plurality of the first flow paths 33 are arranged so as to line up in the Y-direction. Then, a plurality of layers consisting of the plurality of first flow paths 33 arranged in the Y-direction are arranged in the stacking direction of the respective plates.

It should be noted that the first through hole 30 and the second through hole 32 arranged at one ends in the X-direction of the first flow path plate 16 and the second flow path plate 18 are formed in a semicircular shape and opened in the side surface of the stacking block 2 corresponding to the one ends of both the flow path plates 16, 18. An inlet 33*a* of each of the first flow paths 33 is formed by the first through hole 30 and the second through hole 32 opened in the side surface of the stacking block 2. Moreover, the first through hole 30 and the second through hole 32 arranged at other ends in the X-direction of the first flow path plate 16 and the second flow path plate 18 are also formed in a semicircular shape and opened in the side surface of the stacking block 2 corresponding to the other ends of both the flow path plates 16, 18, that is, an opposite side surface of the side surface formed with the inlet 33*a*. An outlet 33*h* of each of the first flow paths 33 is formed by the first through hole 30 and the second through hole 32 opened in the opposite side surface.

Each of the third flow path plates 20 consists of a plate body having the same outer shape as the outer shape of the first flow path plate 16 and the second flow path plate 18. Each of the third flow path plates 20 is stacked on a plate surface of the corresponding second seal plate 26 on the opposite side to the second flow path plate 18. In each of the third flow path plates 20, a plurality of third through holes 34 are formed so as to pass through the third flow path plate 20 in the thickness direction. The respective third through holes 34 are formed in the same constant shape, and concretely, are formed in the same precise circular through hole as the first through holes 30 and the second through holes 32.

Figure 3:
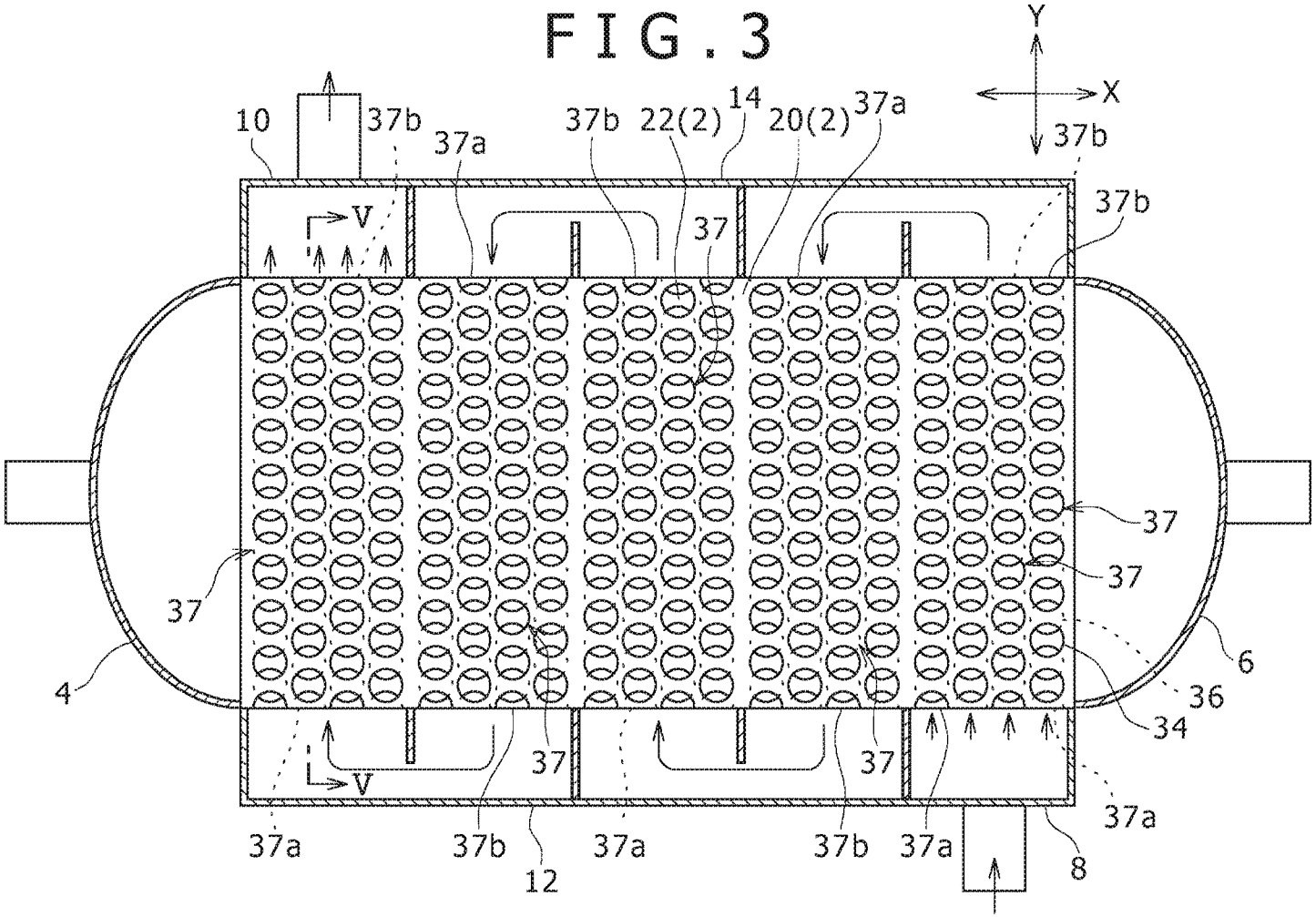
FIG. 3 is a view showing the internal structure of the heat exchanger shown in FIG. 1 and showing a cross section of the boundary part between a second seal plate and a third flow path plate.

Moreover, as shown in FIG. 3, the plurality of third through holes 34 in each of the third flow path plates 20 line up along a plurality of third lines extending in the Y-direction. It should be noted that the Y-direction is an example of "a second direction" of the present invention and is a direction in which the second flow path 37 allows the second fluid to circulate. The plurality of third lines are arranged in parallel in the X-direction and arranged parallel to each other. In each of the third flow path plates 20, the third through holes 34 line up in a constant arrangement pattern in the Y-direction. In each of the third lines, the third through holes 34 line up at equal intervals in the Y-direction. The arrangement interval of the third through holes 34 in the Y-direction is equal to the arrangement interval of the first through holes 30 in the X-direction and the arrangement interval of the second through holes 32 in the X-direction.

Moreover, in each of the third flow path plates 20, the third lines of the third through holes 34 are arranged together so that a predetermined number of (four in the illustrated example) third lines are in a group. Between the respective groups of the third through holes 34, a larger interval than the interval between the third lines adjacent to each other within each of the groups is provided. Then, the third through holes 34 of the third lines adjacent to each other in the X-direction in each of the groups of the third through holes 34 are arranged with a deviation to each other in the Y-direction. Concretely, the third through holes 34 of the third lines adjacent to each other in the X-direction in each of the group of the third through holes 34 are arranged so as to mutually have a deviation in the Y-direction corresponding to half of the interval between the centers of the third through holes 34 lined up in the Y-direction. Moreover, the interval between the third lines of the third through holes 34 adjacent to each other in the X-direction in each of the groups is equal to the interval between the first lines of the first through holes 30 adjacent to each other in the Y-direction and the interval between the second lines of the second through holes 32 adjacent to each other in the Y-direction.

Each of the fourth flow path plates 22 (see FIG. 5) consists of a plate body having the same outer shape as the outer shape of the third flow path plate 20. Each of the fourth flow path plates 22 is stacked on a plate surface 20*a* of the corresponding third flow path plate 20 on the opposite side to the second seal plate 26. In each of the fourth flow path plates 22, a plurality of fourth through holes 36 are formed so as to pass through the fourth flow path plate 22 in the thickness direction. The respective fourth through holes 36 are formed in the same constant shape as the third through holes 34. All the fourth through holes 36 formed in each of the fourth flow path plates 22 are arranged so as to line up in the same constant arrangement pattern as the arrangement pattern of the third through holes 34 in the Y-direction. Concretely, as shown in FIG. 3, the plurality of fourth through holes 36 in each of the fourth flow path plates 22 extend in the Y-direction and line up along a plurality of fourth lines corresponding to the plurality of third lines of the third through holes 34 formed in the third flow path plate 20. The plurality of fourth lines are arranged in parallel in the X-direction and arranged parallel to each other. In each of the fourth lines, the fourth through holes 36 line up at equal intervals in the Y-direction. The arrangement interval of the fourth through holes 36 in each of the fourth lines is equal to the arrangement interval of the third through holes 34 in the Y-direction.

Moreover, in each of the fourth flow path plates 22, the fourth lines of the fourth through holes 36 are arranged together so that a predetermined number of fourth lines are in a group as with the case of the third through holes 34. Between the respective groups of the fourth through holes 36, the interval equal to the interval between the respective groups of the third through holes 34 is provided. Then, the fourth through holes 36 of the fourth lines adjacent to each other in the X-direction in each of the groups of the fourth through holes 36 are arranged with a deviation to each other in the Y-direction. Concretely, the fourth through holes 36 of the fourth lines adjacent to each other in the X-direction in each of the groups of the fourth through holes 36 are arranged so as to mutually have a deviation in the Y-direction corresponding to half of the interval between the centers of the fourth through holes 36 lined up in the Y-direction. Moreover, the interval between the fourth lines of the fourth through holes 36 adjacent to each other in the X-direction in each of the groups of the fourth through holes 36 is equal to the interval between the third lines of the third through holes 34 adjacent to each other in the X-direction in each of the groups of the third through holes 34.

Then, the third through holes 34 of each of the third lines and the fourth through holes 36 of the corresponding fourth line are arranged so as to overlap with a deviation to each other in the Y-direction. In other words, each of the third through holes 34 has regions overlapping respectively with the respective fourth through holes 36 located on both sides of the third through holes 34 in the Y-direction.

The deviation in the Y-direction between the third through hole 34 and the fourth through hole 36 overlapped with each other corresponds to half of the interval between the centers of the third through holes 34 lined up in the Y-direction. The size of the deviation in the Y-direction between the third through hole 34 and the fourth through hole 36 overlapped with each other is equal to the size of the deviation in the X-direction between the first through hole 30 and the second through hole 32 overlapped with each other. In this way, the third through holes 34 of the third line and the fourth through holes 36 of the corresponding fourth line are overlapped with each other with a deviation in the Y-direction, and thereby the third through holes 34 of the third line and the fourth through holes 36 of the corresponding fourth line are alternately connected in the Y-direction in the regions where those through holes overlap.

Figure 5:
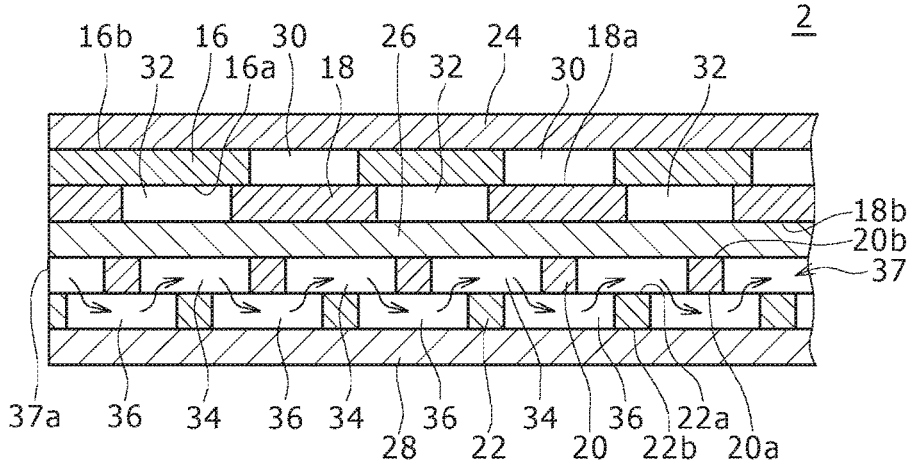
FIG. 5 is a view partially showing a cross section taken along the line V-V in FIG. 3 of the stacking block constituting the heat exchanger.
Figure 6:
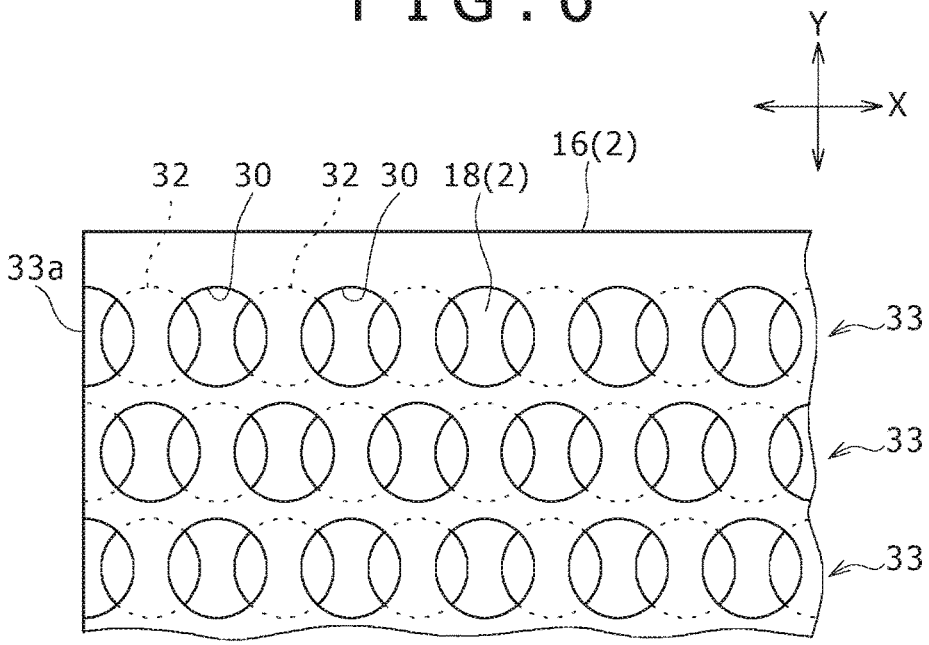
FIG. 6 is a plan view showing a partially enlarged overlapping state of first through holes and second through holes in the first flow path plate and a second flow path plate stacked in the stacking block.

The third seal plate 28 is stacked on a plate surface 22*b* of the corresponding fourth flow path plate 22 on the opposite side to the third flow path plate 20. The openings of the respective third through holes 34 formed in a plate surface 20*b* of the third flow path plate 20 on the opposite side to the fourth flow path plate 22 are sealed by the second seal plate 26, and the openings of the respective fourth through holes 36 formed in the plate surface 22*b* of the fourth flow path plate 22 on the opposite side to the third flow path plate 20 are sealed by the third seal plate 28, and thereby the second flow path 37 meandering in the stacking direction of the plates as shown in FIG. 5 is formed. Within the stacking block 2, a plurality of the second flow paths 37 are arranged so as to line up in the X-direction. Then, a plurality of layers consisting of the plurality of second flow paths 37 arranged in the X-direction are arranged in the stacking direction of the respective plates.

It should be noted that the third through hole 34 arranged at one end in the Y-direction of the third flow path plate 20 and the fourth through hole 36 arranged at one end in the Y-direction of the fourth flow path plate 22 are formed in a semicircular shape. The third through hole 34 and the fourth through hole 36 formed in a semicircular shape are opened in the side surface of the stacking block 2 corresponding to the one ends of both the flow path plates 20, 22, that is, one side surface of the stacking block 2 in the Y-direction. Moreover, the third through hole 34 arranged at other end in the Y-direction of the third flow path plate 20 and the fourth through hole 36 arranged at other end in the Y-direction of the fourth flow path plate 22 are also formed in a semicircular shape. The third through hole 34 and the fourth through hole 36 formed in a semicircular shape are opened in the side surface of the stacking block 2 corresponding to the other ends of both the flow path plates 20, 22, that is, an opposite side surface of the stacking block 2 to the one side surface in the Y-direction.

In the second flow paths 37 of a group closest to the outlets 33*b* of the first flow paths 33 in the stacking block 2, inlets 37*a* of the second flow paths 37 of the group are formed by the third through holes 34 and the fourth through holes 36 corresponding to the second flow paths 37 of the group opened in the one side surface of the stacking block 2 in the Y-direction. Moreover, in the second flow paths 37 of the group, outlets 37*b* of the second flow paths 37 of the group are formed by the third through holes 34 and the fourth through holes 36 corresponding to the second flow paths 37 of the group opened in the opposite side surface of the stacking block 2 in the Y-direction. Then, in the second flow paths 37 of a group next to the second flow paths 37 of the group closest to the outlets 33*b* of the first flow paths 33, the inlets 37*a* of the second flow paths 37 of the group are formed by the third through holes 34 and the fourth through holes 36 corresponding to the second flow paths 37 of the group opened in the opposite side surface of the stacking block 2 in the Y-direction. Moreover, in the second flow paths 37 of the group, the outlets 37*b* of the second flow paths 37 of the group are formed by the third through holes 34 and the fourth through holes 36 corresponding to the second flow paths 37 of the group opened in the one side surface of the stacking block 2 in the Y-direction. In this way, the inlets 37*a* and the outlets 37*b* of the second flow paths 37 of each of the groups lined up toward the inlet 33*a* side from the outlets 33*b* side of the first flow paths 33 are alternately formed in the one side surface and the opposite side surface of the stacking block 2 in the Y-direction.

The first supply header 4 (see FIG. 2) is for distributing and supplying the first fluid being an object fluid of heat exchange to the respective first flow paths 33. The first supply header 4 is attached to the side surface of the stacking block 2 formed with the inlets 33*a* of the first flow paths 33 so as to cover all the inlets 33*a* of the first flow paths 33 formed in the side surface. An internal space of the first supply header 4 is communicated with all the inlets 33*a* of the first flow paths 33. The first fluid introduced in the internal space of the first supply header 4 is distributed and supplied to the respective inlets 33*a* of the first flow paths 33.

The first discharge header 6 (see FIG. 2) is for collectively discharging to the exterior of the heat exchanger the first fluid discharged from the respective first flow paths 33. The first discharge header 6 is attached to the side surface of the stacking block 2 formed with the outlets 33*b* of the first flow paths 33 so as to cover all the outlets 33*b* of the first flow paths 33 formed in the side surface. An internal space of the first discharge header 6 is communicated with all the outlets 33*b* of the first flow paths 33. In the internal space of the first discharge header 6, the first fluids are discharged respectively from the respective outlets 33*b* of the first flow paths 33 and joined together, and the joined fluid is discharged to the exterior of the heat exchanger from the internal space of the first discharge header 6.

The second supply header 8 (see FIG. 3) is for distributing and supplying the second fluid that exchanges heat with the first fluid to the respective second flow paths 37. The second supply header 8 is attached to a region formed with the inlet 37*a* of the second flow paths 37 of a group closest to the outlets 33*b* of the first flow paths 33 of the one side surface of the stacking block 2 in the V-direction. The second supply header 8 covers whole of all the inlets 37*a* of the second flow paths 37 of the group closest to the outlets 33*b* of the first flow paths 33. An internal space of the second supply header 8 is communicated with all the inlets 37*a* of the second flow paths 37 of the group closest to the outlets 33*b* of the first flow paths 33. The second fluid introduced in the internal space of the second supply header 8 is distributed and supplied to the respective inlets 37*a* of the second flow paths 37 of the group communicated with the internal space.

The second discharge header 10 (see FIG. 3) is for collectively discharging to the exterior of the heat exchanger the second fluid discharged from the respective second flow paths 37. The second discharge header 10 is attached to a region formed with the outlets 37*b* of the second flow paths 37 of the group closest to the inlets 33*a* of the first flow paths 33 of the opposite side surface of the stacking block 2 in the Y-direction. The second discharge header 10 covers whole of all the outlets 37*b* of the second flow paths 37 of the group closest to the inlets 33*a* of the first flow paths 33. An internal space of the second discharge header 10 is communicated with all the outlets 37*b* of the second flow paths 37 of the group closest to the inlets 33*a* of the first flow paths 33. In the internal space of the second discharge header 10, the fluids are discharged respectively from the outlets 37*b* of the second flow paths 37 of the group communicated with the internal space and joined together, and the joined fluid is discharged to the exterior of the heat exchanger from the internal space of the second discharge header 10.

The one side circulation header 12 (see FIG. 3) is attached to the one side surface of the stacking block 2 in the Y-direction. The one side circulation header 12 has an internal space communicated with the outlets 37*b* of the second flow paths 37 of each of the groups formed in the one side surface of the stacking block 2 in the Y-direction and with the inlets 37*a* side of the second flow paths 37 of a group adjacent to each other to the inlets 33*a* (see FIG. 2) of the first flow paths 33 with respect to the second flow paths 37 of the group. To the internal space of the one side circulation header 12, the second fluid is discharged respectively from the outlets 37*b* of the respective second flow paths 37 communicated with the internal space. The one side circulation header 12 distributes and supplies to the inlets 37*a* of the respective second flow paths 37 communicated with the internal space the second fluid discharged to the internal space. The one side circulation header 12 is formed integrally with the second supply header 8.

The other side circulation header 14 (see FIG. 3) is attached to the opposite side surface of the stacking block 2 in the Y-direction. The other side circulation header 14 has an internal space communicated with the outlets 37*b* of the second flow paths 37 of each of the groups formed in the opposite side surface of the stacking block 2 in the Y-direction and with the inlets 37*a* of the second flow paths 37 of the group adjacent to each other to the inlets 33*a* (see FIG. 2) side of the first flow paths 33 with respect to the second flow paths 37 of the group. To the internal space of the other side circulation header 14, the second fluid is discharged respectively from the outlets 37*b* of the respective second flow paths 37 communicated with the internal space. The other side circulation header 14 distributes and supplies to the inlets 37*a* of the respective second flow paths 37 communicated with the internal space the second fluid discharged to the internal space. The other side circulation header 14 is formed integrally with the second discharge header 10.

In the thus configured heat exchanger of the present embodiment, the first fluid supplied to the first supply header 4 is introduced from the internal space of the first supply header 4 to the respective first flow paths 33 through their inlets 33*a*, and the second fluid supplied to the second supply header 8 is introduced from the internal space of the second supply header 8 to the second flow paths 37 of the group closest to the outlets 33*b* of the first flow paths 33 through their inlets 37*a*.

The first fluid introduced in the first flow path 33 moves alternately to the first through holes 30 and the second through holes 32 constituting the first flow path 33 while moving to the downstream side in the X-direction. Thereby, the first fluid flows to the downstream side while meandering in the stacking direction of the first flow path plate 16 and the second flow path plate 18. The first fluid reached to the outlet 33*b* of the respective first flow paths 33 is discharged to the internal space of the first discharge header 6.

On the other hand, the second fluid introduced in the second flow paths 37 of the group closest to the outlets 33*b* of the first flow paths 33 moves alternately to the third through holes 34 and the fourth through holes 36 constituting the second flow path 37 while moving to the downstream side in the Y-direction. Thereby, the second fluid flows to the downstream side while meandering in the stacking direction of the third flow path plate 20 and the fourth flow path plate 22. Then, the second fluid reached to the outlets 37*b* of the second flow paths 37 of the group is discharged to the internal space of the other side circulation header 14, and distributed to the respective inlets 37*a* of the second flow paths 37 of the next group through the internal space and introduced therein. Thereafter, the second fluid flows in the second flow paths 37 of the next group oppositely to the second flow paths 37 of the group on the upstream side. Then, the second fluid is discharged to the internal space of the one side circulation header 12 from the outlets 37*b* of the second flow paths 37 of the next group, and distributed to the respective inlets 37*a* of the second flow paths 37 of the further next group through the internal space and introduced therein. Such a circulation in the Y-direction of the second fluid is repeated. Then, the second fluid reached to the outlets 37*b* of the second flow paths 37 of the group closest to the inlets 33*a* of the first flow paths 33 is discharged to the internal space of the second discharge header 10.

As described above, in the course of flow of the first fluid through the respective first flow paths 33 and flow of the second fluid through the respective second flow paths 37, heat exchange between the first fluid and the second fluid is performed.

Next, the production method of the heat exchanger will be described.

Firstly, in a metal plate having a thickness of such as 1 mm and having a dimension slightly larger than the dimension of the first flow path plate 16 in the X-direction, a plurality of precise circular first through holes 30 are formed. On this occasion, the plurality of first through holes 30 are formed by a punching process of blanking the metal plate in the thickness direction with blanking pins. For example, the plurality of first through holes 30 having a diameter of 3 mm are formed in the metal plate. On this occasion, the plurality of first through holes 30 are formed so that the interval between the centers of the first through holes 30 adjacent to each other in the X-direction is 4 mm. Then, the first flow path plate 16 is formed by cutting the portions in the vicinity of both ends in the X-direction of the metal plate formed with the first through holes 30. At this time, the portions in the vicinity of both ends in the X-direction of the metal plate are cut at such a position that the first through holes 30 located on both ends in the X-direction of the first flow path plate 16 after cutting are formed in a semicircular shape. Then, by the steps similar to the above steps, a plurality of similar first flow path plates 16 are formed.

Moreover, in a metal plate similar to the metal plate for forming the first flow path plate 16, a plurality of precise circular second through holes 32 are formed. At this time, by a similar punching process with the use of blanking pins similar to the blanking pins used in the forming step of the first through holes 30, the plurality of second through holes 32 having the same shape as that of the first through holes 30 are formed so that the second through holes 32 line up in the same arrangement pattern as that of the first through holes 30. Then, the second flow path plate 18 is formed by cutting the portions in the vicinity of both ends in the X-direction of the metal plate formed with the second through holes 32. At this time, at a position where the respective second through holes 32 are arranged so that the first through holes 30 and the second through holes 32 overlap with a deviation in the X-direction and the deviation corresponds to half of the interval between the centers of the second through holes 32 lined up in the X-direction in a case where the formed second flow path plate 18 is stacked to the first flow path plate 16 so that the outer edges of the plates 18, 16 are aligned, the portions in the vicinity of both ends of the metal plate are cut. Moreover, at this time, the portions in the vicinity of both ends in the X-direction of the metal plate are cut at such a position that the second through holes 32 located on both ends in the X-direction of the second flow path plate 18 are formed in a semicircular shape. Then, by the steps similar to the above steps, a plurality of similar second flow path plates 18 are formed.

Moreover, in a metal plate having the same thickness as that of the first flow path plate 16 and having a dimension slightly larger than the dimension of the third flow path plate 20 in the Y-direction, a plurality of precise circular third through holes 34 are formed. At this time, by a similar punching process with the use of blanking pins similar to the blanking pins used in the forming step of the first through holes 30, the plurality of third through holes 34 having the same shape as that of the first through holes 30 are formed so that the third through holes 34 line up in the Y-direction. At this time, the respective third through holes 34 are formed so that the arrangement interval of the third through holes 34 in the Y-direction is equal to the arrangement interval of the first through holes 30 in the X-direction. Then, the third flow path plate 20 is formed by cutting the portions in the vicinity of both ends in the Y-direction of the metal plate formed with the third through holes 34. At this time, the portions in the vicinity of both ends in the Y-direction of the metal plate are cut at such a position that the third through holes 34 located on both ends in the Y-direction of the formed third flow path plate 20 are formed in a semicircular shape. Then, by the steps similar to the above steps, a plurality of similar third flow path plates 20 are formed.

Moreover, in a metal plate similar to the metal plate for forming the third flow path plate 20, a plurality of precise circular fourth through holes 36 are formed. At this time, by a similar punching process with the use of blanking pins similar to the blanking pins used in the forming step of the third through holes 34, the plurality of fourth through holes 36 having the same shape as that of the third through holes 34 are formed so that the fourth through holes 36 line up in the same arrangement pattern as that of the third through holes 34. Then, the fourth flow path plate 22 is formed by cutting the portions in the vicinity of both ends in the Y-direction of the metal plate formed with the fourth through holes 36. At this time, at a position where the respective fourth through holes 36 are arranged so that the third through holes 34 and the fourth through holes 36 overlap with a deviation in the Y-direction and the deviation corresponds to half of the interval between the centers of the third through holes 34 lined up in the Y-direction in a case where the formed fourth flow path plate 22 is stacked to the third flow path plate 20 so that the outer edges of the plates 22, 20 are aligned, the portions in the vicinity of both ends of the metal plate are cut. Moreover, at this time, the portions in the vicinity of both ends in the Y-direction of the metal plate are cut at such a position that the fourth through holes 36 located on both ends in the Y-direction of the fourth flow path plate 22 are formed in a semicircular shape. Then, by the steps similar to the above steps, a plurality of similar fourth flow path plates 22 are formed.

Next, the second flow path plate 18 is stacked to the first flow path plate 16. On this occasion, the second flow path plate 18 is overlapped with the first flow path plate 16 so that the outer edge of the second flow path plate 18 is aligned to the outer edge of the second flow path plate 16. Thereby, as viewed from the stacking direction of the first and second flow path plates 16, 18, with respect to the respective first through holes 30 of each of the first lines lined up in the X-direction, the respective second through holes 32 of the corresponding second line are overlapped with a deviation corresponding to half of the interval between the centers of the first through holes 30 lined up in the X-direction, and in the overlapped region, the first through holes 30 and the second through holes 32 are communicated. Thereby, the first through holes 30 and the second through holes 32 are alternately connected in the X-direction.

Then, the first seal plate 24 and the second seal plate 26 respectively made of a metal plate having the same outer shape as the outer shape of the first flow path plate 16 and the second flow path plate 18 are prepared. The first seal plate 24 and the second seal plate 26 are stacked to the first flow path plate 16 and the second flow path plate 18 in a state that they were stacked to each other. On this occasion, the first and second flow path plates 16, 18 are sandwiched between the first and second seal plates 24, 26 from both sides in the stacking direction of those flow path plates 16, 18. Concretely, the first seal plate 24 is stacked on the second plate surface **16*b* of the first flow path plate 16 on the opposite side to the second flow path plate 18, and the second seal plate 26 is stacked on the plate surface 18*b* of the second flow path plate 18 on the opposite side to the first flow path plate 16. Thereby, the openings of the respective first through holes 30 formed in the second plate surface 16*b* of the first flow path plate 16 are sealed by the first seal plate 24, and the openings of the respective second through holes 32 formed in the plate surface 18*b* of the second flow path plate 18 on the opposite side to the first flow path plate 16 are sealed by the second seal plate 26. Thereby, the plurality of first flow paths 33 consisting of the first through holes 30 of each of the first lines and the second through holes 32** of the corresponding second line alternately connected in the X-direction are formed.

Next, the fourth flow path plate 22 is stacked to the third flow path plate 20. On this occasion, the fourth flow path plate 22 is overlapped with the third flow path plate 20 so that the outer edge of the fourth flow path plate 22 is aligned to the outer edge of the third flow path plate 20. Thereby, as viewed from the stacking direction of the third and fourth flow path plates 20, 22, with respect to the respective third through holes 34 of each of the third lines lined up in the Y-direction, the respective fourth through holes 36 of the corresponding fourth line are overlapped with a deviation corresponding to half of the interval between the centers of the third through holes 34 lined up in the V-direction, and in the overlapped region, the third through holes 34 and the fourth through holes 36 are communicated. Thereby, the third through holes 34 and the fourth through holes 36 are alternately connected in the Y-direction.

Then, the second seal plate 26 is stacked to the third flow path plate 20. At this time, the plate surface 20*b* of the third flow path plate 20 on the opposite side to the fourth flow path plate 22 is bonded to the plate surface of the second seal plate 26 on the opposite side to the second flow path plate 18. Whereby, the openings of the respective third through holes 34 formed in the plate surface 20*b* of the third flow path plate 20 on the opposite side to the fourth flow path plate 22 are sealed by the second seal plate 26. Moreover, the third seal plate 28 which is the similar metal plate as the first seal plate 24 and the second seal plate 26 is stacked on the plate surface 22*b* of the fourth flow path plate 22 on the opposite side to the third flow path plate 20. Thereby, the openings of the fourth through holes 36 formed in the plate surface 22*b* of the fourth flow path plate 22 on the opposite side to the third flow path plate 20 are sealed by the third seal plate 28. Thereby, the plurality of second flow paths 37 consisting of the third through holes 34 of each of the third lines and the fourth through holes 36 of the corresponding fourth line alternately connected in the Y-direction are formed.

After this, the respective plates are repeatedly stacked in the same way, and finally all the adjacent plates are diffusion-bonded together, thereby forming the stacking block 2. Then, the first supply header 4 is bonded to one side surface in the X-direction of the formed stacking block 2 by welding and the like, and the first discharge header 6 is bonded to the other side surface in the X-direction of the stacking block 2 by welding and the like. Moreover, the second supply header 8 and the one side circulation header 12 are bonded to one side surface in the Y-direction of the stacking block 2, and the second discharge header 10 and the other side circulation header 14 are bonded to the other side surface in the Y-direction of the stacking block 2. As described above, the heat exchanger of the present embodiment is formed.

In the present embodiment, the plurality of first through holes 30 and the plurality of second through holes 32 forming the first flow path 33 are formed in the same constant shape and line up in the same arrangement pattern, and the plurality of third through holes 34 and the plurality of fourth through holes 36 forming the second flow path 37 are formed in the same constant shape and line up in the same constant arrangement pattern. Further, the shape and arrangement pattern of the first through holes 30 and second through holes 32 and the shape and arrangement pattern of the third through holes 34 and fourth through holes 36 are the same. Therefore, compared to the case where a plurality of through holes having different shapes are formed in the respective flow path plates, the arrangement pattern of the through holes is irregular, or the arrangement pattern of the through holes is different with respect to each of the respective flow path plates, the internal structure of the stacking block 2 can be simplified, and the forming steps of the first to fourth through holes 30, 32, 34, and 36 can be simplified. As a result, the internal structure of the stacked heat exchanger can be simplified, the production steps of the heat exchanger can be simplified, and the production cost of the heat exchanger can be reduced.

Moreover, in the present embodiment, the first to fourth through holes 30, 32, 34, and 36 are circular through holes, so the shape of the first to fourth through holes 30, 32, 34, and 36 can be simplified compared to the case where the through holes have a complicated shape such as polygon or the like. As a result, the internal structure of the heat exchanger can be further simplified, and the forming steps of the first to fourth through holes 30, 32, 34, and 36 can be further simplified.

Moreover, in the present embodiment, by punching the respective flow path plates 16, 18, 20, and 22 with blanking pins, the corresponding respective through holes 30, 32, 34, and 36 are formed. Therefore, compared to the conventional production method of the heat exchanger in which the through holes are formed by an etching processing or a laser processing, the respective through holes 30, 32, 34, and 36 can be easily formed, and the processing cost of those through holes 30, 32, 34, and 36 can be reduced.

Moreover, in the present embodiment, the one side circulation header 12 and the other side circulation header 14 attached to the respective side surfaces in the Y-direction of the stacking block 2 can allow the second fluid flowed through the second flow paths 37 of the group on the upstream side to flow through the second flow paths 37 of the group on the downstream side by reversing the direction of the flow thereof. Therefore, while arranging the third through holes 34 and the fourth through holes 36 in the third flow path plate 20 and the fourth flow path plate 22 so as to line up linearly in the Y-direction, the whole heat exchanger can allow the second fluid to flow meanderingly in a large way so that the direction of the flow of the second fluid is alternately reversed in the Y-direction. Here, it is assumed that there is a heat exchanger in which the second flow paths are formed by the third through holes and the fourth through holes lined up linearly in the X-direction of the stacking block 2 and the second flow paths are arranged in parallel from one end to the other end in the Y-direction of the stacking block 2 at the same interval as the second flow paths 37 of the respective groups of the present embodiment. The sum of the widths in the X-direction of the second flow paths 2 constituting each group of the present embodiment is smaller than the sum of the widths in the Y-direction of the second flow paths lined up in the Y-direction in the assumed heat exchanger above. Therefore, if the second fluid is allowed to flow at the same flow rate through the heat exchanger of the present embodiment and the assumed heat exchanger above, in the heat exchanger of the present embodiment, the flow velocity of the second fluid flowing through the second flow path 37 is larger than the flow velocity of the second fluid flowing through the second flow path of the assumed heat exchanger above. As a result, in the present embodiment, heat exchange between the first fluid and the second fluid can be facilitated. Based upon the foregoing, in the present embodiment, heat exchange between the first fluid and the second fluid can be facilitated while preventing the arrangement of the third through holes 34 and the fourth through holes 36 from being complicated.

It should be noted that the embodiments disclosed herein are to be considered in all the respects as illustrative and not restrictive. The scope of the present invention is indicated not by the aforementioned description of embodiments but by the claims, and it is intended that all changes within the equivalent meaning and scope to the claims may be included therein.

It is possible to arbitrarily set the thickness of the respective plates, the diameter of the first to fourth through holes, the arrangement interval of the first through holes in the X-direction and the arrangement interval of the second through holes in the X-direction, and the arrangement interval of the third through holes in the Y-direction and the arrangement interval of the fourth through holes in the Y-direction.

Moreover, the shape of the respective through holes is not necessarily restricted to a precise circle. For example, the respective through holes may be formed in an ellipse, a polygon, or other various shapes.

Moreover, the heat exchanger of the present invention is not necessarily restricted to those in which the second flow path, the one side circulation header, and the other side circulation header are configured so that the second fluid flows oppositely to each other in the respective second flow paths of the adjacent groups in the X-direction as in the above embodiment. For example, the second fluid may flow from one side to the other side in the Y-direction in all the second flow paths.

Moreover, the third through holes and the fourth through holes are arranged so that the third through holes and the fourth through holes line up in the same direction (X-direction) as the direction in which the first through holes and the second through holes line up, thereby the second flow path may be formed so that the second fluid flows along the direction in which the first fluid flows through the first flow path.

Moreover, the first through holes may be formed in the first flow path plate in such an arrangement pattern that the lines of the first through holes largely meander in the plane surface of the first flow path plate, and the second through holes may be formed in the second flow path plate in such an arrangement pattern that the lines of the second through holes largely meander in the plane surface of the second flow path plate. Whereby, as viewed from the stacking direction of the first flow path plate and the second flow path plate, the respective first flow paths may be formed so that the first flow path forms a meandering shape.

Moreover, the third through holes may be formed in the third flow path plate in such an arrangement pattern that the lines of the third through holes largely meander in the plane surface of the third flow path plate, and the fourth through holes may be formed in the fourth flow path plate in such an arrangement pattern that the lines of the fourth through holes largely meander in the plane surface of the fourth flow path plate. Whereby, the respective second flow paths may be formed in the meandering shape similar to the first flow paths.

Moreover, the second flow path is not necessarily a flow path formed by the through holes being alternately connected. For example, the second flow path may be a flow path consisting of grooves formed in the flow path plate.

Figure 7:
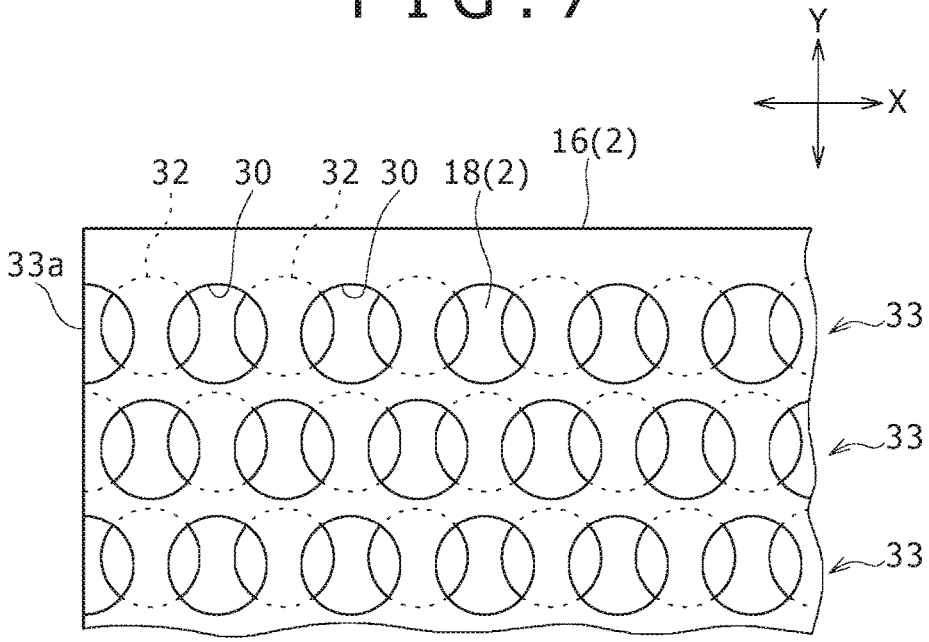
FIG. 7 is a view corresponding to FIG. 6 showing an overlapping state of the first through holes and the second through holes in a first modification of the present invention.

Moreover, as in a first modification shown in FIG. 7, the first through holes 30 of each of the first lines and the second through holes 32 of the corresponding second line may overlap with a deviation to each other in both the X-direction and the Y-direction orthogonal to the X-direction. Moreover, similarly, the third through holes 34 of each of the third lines and the fourth through holes 36 of the corresponding fourth line may overlap with a deviation to each other in both the Y-direction and the X-direction orthogonal to the Y-direction.

In the first modification, by the first through holes 30 and the second through holes 32, the first flow path 33 which allows the first fluid to flow to the downstream side while moving the first fluid not only in the stacking direction of the first and second flow path plates 16, 18 but also in the Y-direction is formed. Moreover, by the third through holes 34 and the fourth through holes 36, the second flow path 37 which allows the second fluid to flow to the downstream side while moving the second, fluid not only in the stacking direction of the third and fourth flow path plates 20, 22 but also in the X-direction is formed. Accordingly, turbulence of the flow of the first and second fluids can be facilitated, and as a result, heat exchange between the first fluid and the second fluid can be facilitated.

Figure 8:
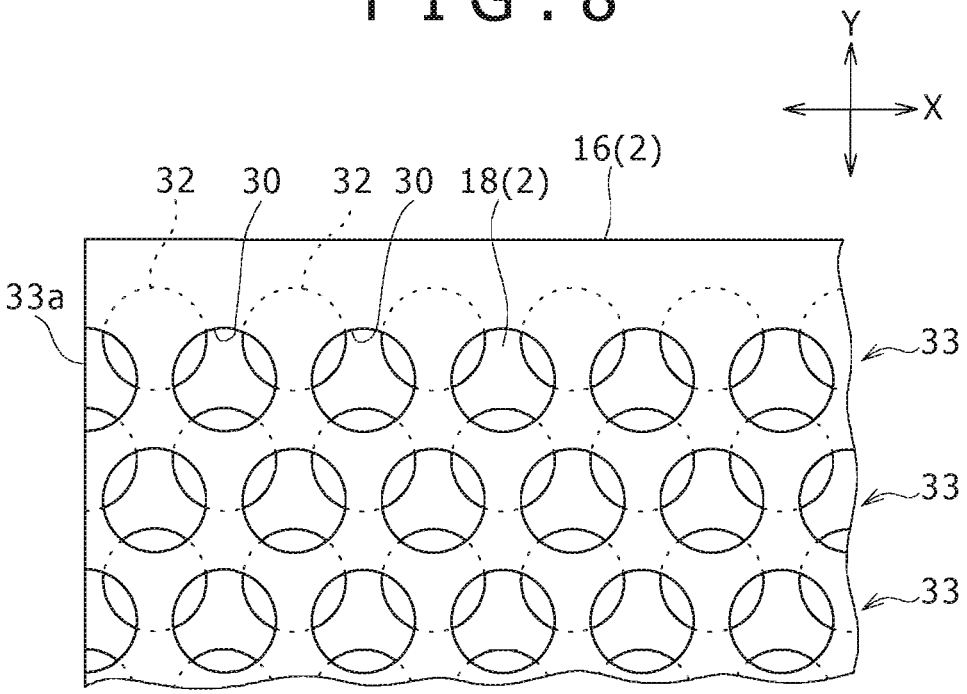
FIG. 8 is a view corresponding to FIG. 6 showing an overlapping state of the first through holes and the second through holes in a second modification of the present invention.

Moreover, as in a second modification shown in FIG. 8, the first through holes 30 of each of the first lines and the second through holes 32 of the corresponding second line may overlap with a deviation to each other in both the X-direction and the Y-direction orthogonal to the X-direction, and in addition to that, the first through holes 30 of each of the first lines may overlap with the second through holes 32 of the adjacent second line in the Y-direction with a deviation to each other. Moreover, similarly, the third through holes 34 of each of the third lines and the fourth through holes 36 of the corresponding fourth line may overlap with a deviation to each other in both the Y-direction and the X-direction orthogonal to the Y-direction, and in addition to that, the third through holes 34 of each of the third lines may overlap with the fourth through holes 36 of the adjacent fourth line in the X-direction with a deviation to each other.

In the second modification, in the region where the first through holes 30 of the first line and the second through holes 32 of the second line adjacent to each other in the Y-direction overlap, the adjacent first flow paths 33 are communicated, and in the region where the third through holes 34 of the third line and the fourth through holes 36 of the fourth line adjacent to each other in the X-direction overlap, the adjacent second flow paths 37 are communicated. Therefore, the first fluid flowing through each of the first flow paths 33 not only flows meanderingly along the first flow path 33 but also flows to the downstream side while moving to the next first flow path 33, and the second fluid flowing through each of the second flow paths 37 not only flows meanderingly along the second flow path 37 but also flows to the downstream side while moving to the next second flow path 37. Therefore, turbulence of the flow of the first and second fluids can be further facilitated. As a result, heat exchange between the first fluid and the second fluid can be further facilitated.

Figure 9:
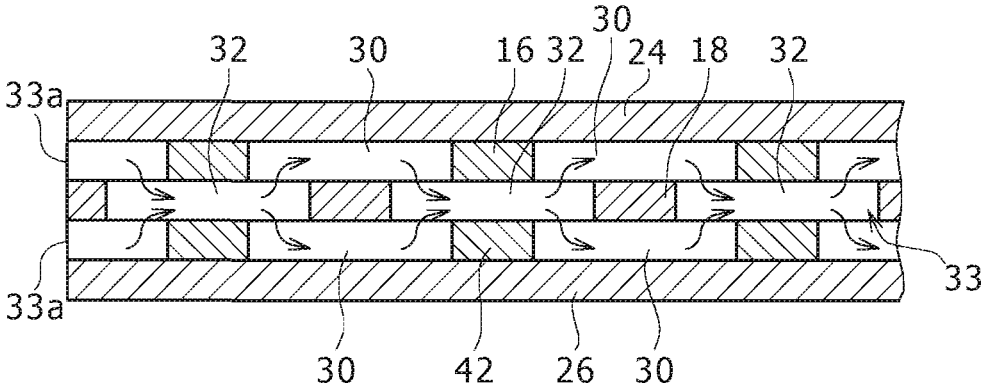
FIG. 9 is a partial cross sectional view in the stacking direction of the stacking block along a first flow path in a third modification of the present invention for illustrating a structure of the first flow path.

Moreover, as in a third modification shown in FIG. 9, as the flow path plate forming the first flow path 33, in addition to the first flow path plate 16 and the second flow path plate 18, a flow path plate 42 having the configuration similar to the first flow path plate 16 may be stacked to the second flow path plate 18 on the opposite side to the first flow path plate 16. Whereby, such a first flow path 33 that the first fluid flows to the downstream side while alternately repeating branch and joint in the stacking direction of the first flow path plate 16 and the second flow path plate 18 may be formed. Similarly, as the flow path plate forming the second flow path 37, in addition to the third flow path plate 20 and the fourth flow path plate 22, a flow path plate having the configuration similar to the third flow path plate 20 may be stacked to the fourth flow path plate 22 on the opposite side to the second flow path plate 20. Whereby, such a second flow path 37 that the second fluid flows to the downstream side while alternately repeating branch and joint in the stacking direction of the third flow path plate 20 and the fourth flow path plate 22 may be formed.

Figure 10:
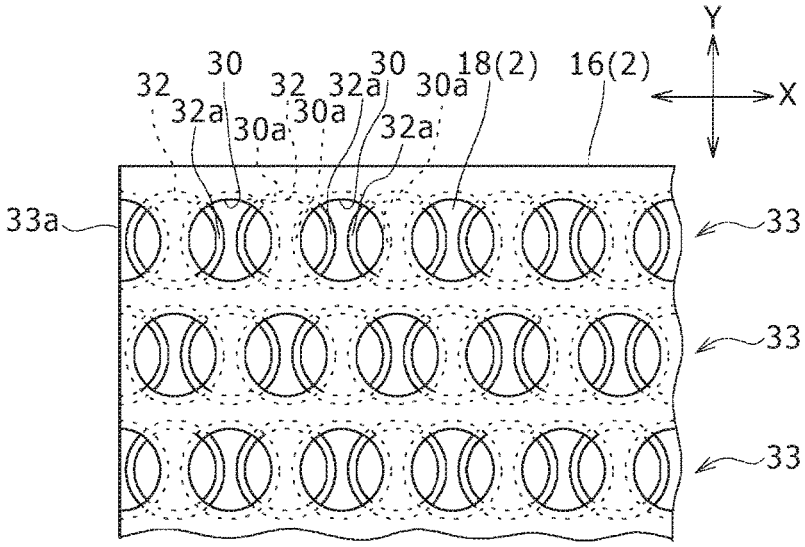
FIG. 10 is a view corresponding to FIG. 6 showing an overlapping state of the first through holes and the second through holes in a fourth modification of the present invention.
Figure 11:
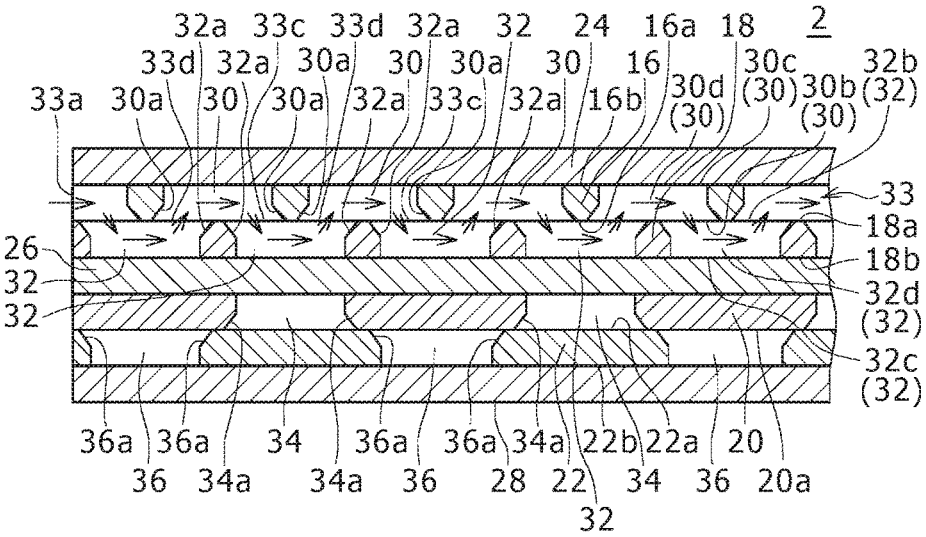
FIG. 11 is a view corresponding to FIG. 4 showing a cross section taken along the first flow path of the stacking block according to the fourth modification shown in FIG. 10.
Figure 12:
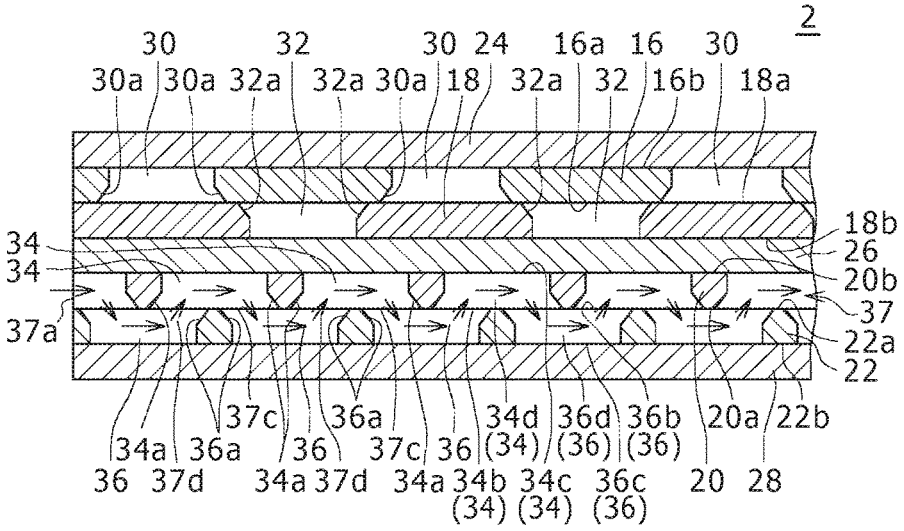
FIG. 12 is a view corresponding to FIG. 5 showing a cross section taken along a second flow path of the stacking block according to the fourth modification shown in FIG. 10.

Moreover, as in a fourth modification shown in FIG. 10 to FIG. 12, the respective through holes 30, 32, 34, and 36 may be formed so that the diameter of each of the through holes 30, 32, 34, and 36 is different at the respective position in the axial direction (the thickness direction of the respective flow path plates 16, 18, 20, and 22) of the through holes.

Concretely, as shown in FIG. 11, each of the first through holes 30 consists of a first through hole one end part 30*b* formed in the first plate surface 16*a* of the first flow path plate 16, a first through hole other end part 30*c* formed in the second plate surface 16*b* of the first flow path plate 16, and a first through hole intermediate part 30*d* which is all the portions between the first through hole one end part 30*b* and the first through hole other end part 30*c* of the first through hole 30. The first through hole other end part 30*c* has a diameter smaller than the diameter of the first through hole one end part 30*b*. Moreover, the first through hole intermediate part 30*d* is formed so that the diameter of the first through hole intermediate part 30*d* at all the positions in the axial direction is not less than the diameter of the first through hole other end part 30*c* and not more than the diameter of the first through hole one end part 30*b*.

Moreover, as shown in FIG. 11, each of the second through holes 32 consists of a second through hole one end part 32*b* formed in the plate surface 18*a* of the second flow path plate 18 on the first flow path plate 16 side, a second through hole other end part 32*c* formed in the plate surface 18*b* of the second flow path plate 18 on the second seal plate 26 side, and a second through hole intermediate part 32*d* which is all the portions between the second through hole one end part 32*b* and the second through hole other end part 32*c* of the second through hole 32. The second through hole other end part 32*c* has a diameter smaller than the diameter of the second through hole one end part 32*b*. Moreover, the second through hole intermediate part 32*d* is formed so that the diameter of the second through hole intermediate part 32*d* at all the positions in the axial direction is not less than the diameter of the second through hole other end part 32*c* and not more than the diameter of the second through hole one end part 32*b*.

Moreover, as shown in FIG. 12, each of the third through holes 34 consists of a third through hole one end part 34*b* formed in the plate surface 20*a* of the third flow path plate 20 on the opposite side to the second seal plate 26, a third through hole other end part 34*c* formed in the plate surface 20*b* of the third flow path plate 20 on the second seal plate 26 side, and a third through hole intermediate part 34*d* which is all the portions between the third through hole one end part 34*b* and the third through hole other end part 34*c* of the third through hole 34. The third through hole other end part 34*c* has a diameter smaller than the diameter of the third through hole one end part 34*b*. The third through hole intermediate part 34*d* is formed so that the diameter of the third through hole intermediate part 34*d* at all the positions in the axial direction is not less than the diameter of the third through hole other end part 34*c* and not more than the diameter of the third through hole one end part 34*b*.

Moreover, as shown in FIG. 12, each of the fourth through holes 36 consists of a fourth through hole one end part 36*b* formed in the plate surface 22*a* of the fourth flow path plate 22 on the third flow path plate 20 side, a fourth through hole other end part 36*c* formed in the plate surface 22*b* of the fourth flow path plate 22 on the third seal plate 28 side, and a fourth through hole intermediate part 36*d* which is all the portions between the fourth through hole one end part 36*b* and the fourth through hole other end part 36*c* of the fourth through hole 36. The fourth through hole other end part 36*c* has a diameter smaller than the diameter of the fourth through hole one end part 36*b*. The fourth through hole intermediate part 36*d* is formed so that the diameter of the fourth through hole intermediate part 36*d* at all the positions in the axial direction is not less than the diameter of the fourth through hole other end part 36*c* and not more than the diameter of the fourth through hole one end part 36*b*.

More concretely, in the fourth modification, the inner peripheral surface of the first flow path plate 16 surrounding each of the first through holes 30 has a first tapered surface part 30*a* in the form of taper, and the inner peripheral surface of the second flow path plate 18 surrounding each of the second through holes 32 has a second tapered surface part 32*a* in the form of taper. Moreover, the inner peripheral surface of the third flow path plate 20 surrounding each of the third through holes 34 has a third tapered surface part 34*a* in the form of taper, and the inner peripheral surface of the fourth flow path plate 22 surrounding each of the fourth through holes 36 has a fourth tapered surface part 36*a* in the form of taper.

Specifically, the inner peripheral surface surrounding each of the first through holes 30 has the first tapered surface part 30*a* extending a range from the first plate surface 16*a* of the first flow path plate 16 on which the second flow path plate 18 is stacked to a predetermined intermediate position in the thickness direction of the first flow path plate 16. The first tapered surface 30*a* is formed in a tapered shape toward the inside of the radial direction of the first through hole 30 as it approaches to the first seal plate 24 side from the first plate surface 16*a* of the first flow path plate 16. That is, the first tapered surface part 30*a* is reduced in diameter as it approaches to the first seal plate 24 side from the first plate surface 16*a*.

The inner peripheral surface surrounding each of the second through holes 32 has the second tapered surface part 32*a* extending a range from one plate surface 18*a* in the thickness direction of the second flow path plate 18 to a predetermined intermediate position in the thickness direction of the second flow path plate 18. The one plate surface 18*a* of the second flow path plate 18 is a plate surface on the first flow path plate 16 side stacked thereon. The second tapered surface 32*a* is formed in a tapered shape toward the inside of the radial direction of the second through hole 32 as it approaches to the second seal plate 26 side from the plate surface 18*a* of the second flow path plate 18 on the first flow path plate 16 side. That is, the second tapered surface part 32*a* is reduced in diameter as it approaches to the second seal plate 26 side from the plate surface 18*a* of the second flow path plate 18 on the first flow path plate 16 side.

The inner peripheral surface surrounding each of the third through holes 34 has the third tapered surface part 34*a* extending a range from one plate surface 20*a* in the thickness direction of the third flow path plate 20 to a predetermined intermediate position in the thickness direction of the third flow path plate 20. The one plate surface 20*a* of the third flow path plate 20 is a plate surface on the opposite side to the second seal plate 26. The third tapered surface 34*a* is formed in a tapered shape toward the inside of the radial direction of the third through hole 34 as it approaches to the second seal plate 26 side from the plate surface 20*a* of the third flow path plate 20 on the opposite side to the second seal plate 26. That is, the third tapered surface part 34*a* is reduced in diameter as it approaches to the second seal plate 26 side from the plate surface 20*a* of the third flow path plate 20 on the opposite side to the second seal plate 26.

The inner peripheral surface surrounding each of the fourth through holes 36 has the fourth tapered surface part 36*a* extending a range from one plate surface 22*a* in the thickness direction of the fourth flow path plate 22 to a predetermined intermediate position in the thickness direction of the fourth flow path plate 22. The one plate surface 22*a* of the fourth flow path plate 22 is a plate surface on the third flow path plate 20 side. The fourth tapered surface 36*a* is formed in a tapered shape toward the inside of the radial direction of the fourth through hole 36 as it approaches to the third seal plate 28 side from the plate surface 22*a* of the fourth flow path plate 22 on the third flow path plate 20 side. That is, the fourth tapered surface part 36*a* is reduced in diameter as it approaches to the third seal plate 28 side from the plate surface 22*a* of the fourth flow path plate 22 on the third flow path plate 20 side.

As shown in FIG. 11, the first flow path 33 has a plurality of first connection parts 33*c* formed by the end parts on the downstream side of the respective first through holes 30 and the end parts on the upstream side of the respective second through holes 32 connected thereto, and a plurality of second connection parts 33*d* formed by the end parts on the downstream side of the respective second through holes 32 and the end parts on the upstream side of the respective first through holes 30 connected thereto. The first connection part 33*c* is defined by the portion located on the downstream side in the flow direction of the first fluid of the first tapered surface part 30*a* of the first through hole 30 and the portion located on the upstream side in the flow direction of the first fluid of the second tapered surface part 32*a* of the corresponding second through hole 32. The second connection part 33*d* is defined by the portion located on the downstream side in the flow direction of the first fluid of the second tapered surface part 32*a* of the second through hole 32 and the portion located on the upstream side in the flow direction of the first fluid of the first tapered surface part 30*a* of the corresponding first through hole 30. The first tapered surface part 30*a* and the second tapered surface part 32*a* are formed in the tapered shape described above, thereby the respective first connection parts 33*c* and the respective second connection parts 33*d* have a shape inclined to the downstream side of the first flow path 33 with respect to the stacking direction of the first and second flow path plates 16, 18.

Then, in the fourth modification, the respective diameters of the first through holes one end part 30*b*, the first through hole other end part 30*c*, the first through hole intermediate part 30*d*, the second through hole one end part 32*b*, the second through hole other end part 32*c*, and the second through hole intermediate part 32*d* are configured as described above, and the inner peripheral surface surrounding the first through hole 30 has the first tapered surface part 30*a* and the inner peripheral surface part 32*a* surrounding the second through hole 32 has the second tapered surface part 32*a*, thereby the change in the cross sectional area of the first flow path 33 in the portion from the first through holes 30 to the second through holes 32 via the first connection part 33*c* and the change in the cross sectional area of the first flow path 33 in the portion from the second through holes 32 to the first through holes 30 via the second connection part 33*d* are moderate compared to the case of the above first embodiment. It should be noted that the cross sectional area of the first flow path 33 is the area of the cross section of the first flow path 33 in the direction orthogonal to the arrangement direction (X-direction) of the first through holes 30 constituting the first flow path 33 and orthogonal to the plate surfaces 16*a*, 18*a* of the first and second flow path plates 16, 18. Since the change in the cross sectional area of the first flow path 33 is thus moderate, in the end part on the downstream side and the end part on the upstream side of the first through hole 30 and the end part on the downstream side and the end part on the upstream side of the second through hole 32, generation of a vortex of the first fluid due to a rapid change in the flow path cross sectional area can be suppressed. As a result, the increase in resistance due to vortex of the first fluid is suppressed and the pressure loss of the first flow path 33 can be reduced.

Moreover, as shown in FIG. 12, the second flow path 37 has a plurality of third connection parts 37*c* formed by the end parts on the downstream side of the respective third through holes 34 and the end parts on the upstream side of the fourth through holes 36 connected thereto, and a plurality of fourth connection parts 37*d* formed by the end parts on the downstream side of the respective fourth through holes 36 and the end parts on the upstream side of the third through holes 34 connected thereto. The third connection part 37*c* is defined by the portion located on the downstream side in the flow direction of the second fluid of the third tapered surface part 34*a* of the third through hole 34 and the portion located on the upstream side in the flow direction of the second fluid of the fourth tapered surface part 36*a* of the corresponding fourth through hole 36. The fourth connection part 37*d* is defined by the portion located on the downstream side in the flow direction of the second fluid of the fourth tapered surface part 36*a* of the fourth through hole 36 and the portion located on the upstream side in the flow direction of the second fluid of the third tapered surface part 34*a* of the corresponding third through hole 34. The third tapered surface part 34*a* and the fourth tapered surface part 36*a* are formed in the tapered shape described above, thereby the respective third connection parts 37*c* and the respective fourth connection parts 37*d* have a shape inclined to the downstream side of the second flow path 37 with respect to the stacking direction of the third and fourth flow path plates 20, 22.

Then, in the fourth modification, the respective diameters of the third through holes one end part 34*b*, the third through hole other end part 34*c*, the third through hole intermediate part 34*d*, the fourth through hole one end part 36*b*, the fourth through hole other end part 36*c*, and the fourth through hole intermediate part 36*d* are configured as described above, and the inner peripheral surface surrounding the third through hole 34 has the third tapered surface part 34*a* and the inner peripheral surface part 36*a* surrounding the fourth through hole 36 has the fourth tapered surface part 36*a*, thereby the change in the cross sectional area of the second flow path 37 in the portion from the third through holes 34 to the fourth through holes 36 via the third connection part 37*c* and the change in the cross sectional area of the second flow path 37 in the portion from the fourth through holes 36 to the third through holes 34 via the fourth connection part 37*d* are moderate compared to the case of the above first embodiment. It should be noted that the cross sectional area of the second flow path 37 is the area of the cross section of the second flow path 37 in the direction orthogonal to the arrangement direction (Y-direction) of the third through holes 34 constituting the second flow path 37 and orthogonal to the plate surfaces 20*a*, 22*a* of the third and fourth flow path plates 20, 22. Since the change in the cross sectional area of the second flow path 37 is thus moderate, in the end part on the downstream side and the end part on the upstream side of the third through hole 34 and the end part on the downstream side and the end part on the upstream side of the fourth through hole 36, generation of a vortex of the second fluid due to a rapid change in the flow path cross sectional area can be suppressed. As a result, the increase in resistance due to vortex of the second fluid is suppressed and the pressure loss of the second flow path 37 can be reduced.

It should be noted that in the fourth modification in accordance with FIG. 10 to FIG. 12, although the respective inner peripheral surfaces surrounding the respective through holes 30, 32, 34, and 36 having the corresponding tapered surface parts respectively were shown in the configuration in which the first to fourth through holes 30, 32, 34, and 36 are arranged in the arrangement similar to the above embodiment, the respective inner peripheral surfaces surrounding the respective through holes may have similarly tapered surface parts also in the respective modifications shown in FIG. 7 and FIG. 8.

Moreover, the respective tapered surface parts 30*a*, 32*a*, 34*a*, and 36*a* may be formed in a tapered shape rounded in the cross section along the axial direction of the corresponding respective through holes 30, 32, 34, and 36.

Moreover, the respective inner peripheral surfaces surrounding the respective through holes 30, 32, 34, and 36 may be a tapered surface part as a whole.

Moreover, as long as the diameter of the other end part of each of the through holes constituting each of the flow paths is smaller than the diameter of the one end part of the through hole and the diameter of the intermediate part of each through hole is not less than the diameter of the one end part of the through hole and not more than the diameter of the other end part of the through hole, the inner peripheral surface surrounding each through hole does not necessarily have a tapered surface. For example, the inner peripheral surface surrounding each through hole may be formed in a stepped shape toward the inside of the through hole as it approaches to the other end part from the one end part of the through hole. Formation technique of the through holes in the respective flow path plates is not necessarily restricted to a punching process. For example, the through holes may be formed by water-jet machining.

Moreover, by allowing a third fluid different from the first, and second fluids to flow through the flow paths of the layers in a predetermined numbers among a plurality of layers where the first flow paths are arranged and a plurality of layers where the second flow paths are arranged of the above heat exchanger, heat exchange between the first, second and third fluids may be performed. Similarly, by allowing a large number of different fluids than three fluids to flow, heat exchange between those fluids may be performed.

SUMMARY OF EMBODIMENTS

The above embodiment is summarized as follows.

The heat exchanger according to the above embodiment is a heat exchanger that allows at least a first fluid and a second fluid to exchange heat therebetween while allowing those fluids to circulate, the heat exchanger being provided with a stacking block having therein a first flow path that allows the first fluid to circulate and a second flow path that allows the second fluid to circulate, in which the stacking block has: a first plate surface being a plate surface on one side; a second plate surface being a plate surface on the opposite side to the first plate surface; a first flow path plate formed with a plurality of first through holes having a constant shape; a second flow path plate formed with a plurality of second through holes having the same constant shape as the first through holes; a first seal plate stacked on the second plate surface; and a second seal plate stacked on a plate surface of the second flow path plate on the opposite side to the first flow path plate, in the first flow path plate, the first through holes are arranged so as to line up in a constant arrangement pattern in a first direction in which the first flow path allows the first fluid to flow, in the second flow path plate, the second through holes are arranged so as to line up in the first direction in the same constant arrangement pattern as the first through holes, and each of the first through holes has regions overlapping with the second through holes located on both sides of the first through hole in the first direction, and the first flow path is formed by the first through holes and the second through holes being alternately connected in the first direction in the regions where those through holes overlap.

In the heat exchanger, the first through holes and the second through holes forming the first flow path are formed in the first flow path plate and the second flow path plate so as to have the same constant shape and are arranged so as to line up in the same constant arrangement pattern. Therefore, compared to the case where through holes having different shapes are formed in the respective flow path plates, the arrangement pattern in which the respective through holes line up is irregular, or the arrangement pattern of the first through holes in the first flow path plate and the arrangement pattern of the second through holes in the second flow path plate are different, the internal structure of the stacking block is simplified. As a result, the production cost of the heat exchanger can be reduced.

In the above heat exchanger, the respective first through holes and the respective second through holes are preferably circular through holes.

According to this configuration, the shape of the respective first through holes and the respective second through holes can be simplified compared to the case where the respective first through holes and the respective second through holes are through holes having a complicated shape such as polygon or the like.

In the above heat exchanger, viewed from the stacking direction of the first flow path plate and the second flow path plate, the respective first through holes and the respective second through holes connected to the first through holes preferably overlap with a deviation to each other in the direction orthogonal to the first direction.

According to this configuration, by the first through holes and the second through holes, such a first flow path that the first fluid flows in the first direction while moving not only in the stacking direction of the first flow path plate and the second flow path plate but also in the direction orthogonal to the first direction can be formed. Therefore, the residence time of the first fluid in the first flow path can be extended. As a result, heat exchange between the first fluid and the second fluid can be facilitated.

In this case, preferably, the plurality of first through holes formed in the first flow path plate line up along a plurality of first lines extending in the first direction, the plurality of second through holes formed in the second flow path plate line up along a plurality of second lines extending in the first direction and corresponding to the plurality of first lines, the first through holes of each of the first lines and the second through holes of the corresponding second line overlap with a deviation to each other in both the first direction and the direction orthogonal to the first direction, and the first through holes of each of the first lines overlap with the second through holes of the adjacent second line in the direction orthogonal to the first direction with a deviation to each other.

According to this configuration, the first flow paths adjacent to each other are communicated in the region where the first through holes of the first line and the second through holes of the second line adjacent to each other in the direction orthogonal to the first direction overlap. Therefore, the first fluid flowing through each of the first flow paths flows to the downstream side while moving also to the next first flow path. Therefore, the residence time of the first fluid within the heat exchanger can be further extended. As a result, heat exchange between the first fluid and the second fluid can be further facilitated.

In the above heat exchanger, preferably, each of the first through holes consists of a first through hole one end part formed in the first plate surface, a first through hole other end part formed in the second plate surface, and a first through hole intermediate part which is a portion between the first through hole one end part and the first through hole other end part of the first through hole, the first through hole other end part has a diameter smaller than the diameter of the first through hole one end part, and the first through hole intermediate part is formed so that the diameter thereof is not less than the diameter of the first through hole other end part and not more than the diameter of the first through hole one end part. Preferably, each of the second through holes consists of a second through hole one end part formed in a plate surface of the second flow path plate on the first flow path plate side, a second through hole other end part formed in a plate surface of the second flow path plate on the second seal plate side, and a second through hole intermediate part which is a portion between the second through hole one end part and the second through hole other end part of the second through hole, the second through hole other end part has a diameter smaller than the diameter of the second through hole one end part, and the second through hole intermediate part is formed so that the diameter thereof is not less than the diameter of the second through hole other end part and not more than the diameter of the second through hole one end part.

In this configuration, the first through hole other end part has a diameter smaller than the diameter of the first through hole one end part, and the first through hole intermediate part is formed so that the diameter thereof is not less than the diameter of the first through hole other end part and not more than the diameter of the first through hole one end part, and further, the second through hole other end part has a diameter smaller than the diameter of the second through hole one end part, and the second through hole intermediate part is formed so that the diameter thereof is not less than the diameter of the second through hole other end part and not more than the diameter of the second through hole one end part, thereby the change in the cross sectional area of the first flow path in the portion from the end part on the downstream side of the first through hole to the end part on the upstream side of the second through hole connected thereto and the portion from the end part on the downstream side of the second through hole to the end part on the upstream side of the first through hole connected thereto can be moderated. As a result, in the end part on the downstream side and the end part on the upstream side of the first through hole and the end part on the downstream side and the end part on the upstream side of the second through hole, generation of a vortex of the first fluid due to a rapid change in the flow path cross sectional area can be suppressed. As a result, the increase in resistance due to vortex of the first fluid is suppressed and the pressure loss of the first flow path can be reduced.

Moreover, in the above heat exchanger, preferably, the inner peripheral surface of the first flow path plate surrounding each of the first through holes has a first tapered surface part formed in a tapered shape toward the inside of the first through hole as it approaches to the first seal plate side from the first plate surface of the first flow path plate, and the inner peripheral surface of the second flow path plate surrounding each of the second through holes has a second tapered surface part formed in a tapered shape toward the inside of the second through hole as it approaches to the second seal plate side from the plate surface of the second flow path plate on the first flow path plate side.

In this configuration, the inner peripheral surface surrounding each of the first through holes has the first tapered surface part formed in the tapered shape described above, and the inner peripheral surface surrounding each of the second through holes has the second tapered surface part formed in the tapered shape described above, thereby the change in the cross sectional area of the first flow path in the portion from the end part on the downstream side of the first through hole to the end part on the upstream side of the second through hole connected thereto and the portion from the end part on the downstream side of the second through hole to the end part on the upstream side of the first through hole connected thereto can be moderated. As a result, in the end part on the downstream side and the end part on the upstream side of the first through hole and the end part on the downstream side and the end part on the upstream side of the second through hole, generation of a vortex of the first fluid due to a rapid change in the flow path cross sectional area can be suppressed. As a result, the increase in resistance due to vortex of the first fluid is suppressed and the pressure loss of the first flow path can be reduced.

In the above heat exchanger, preferably, the stacking block has a third flow path plate which is stacked on a plate surface of the second seal plate on the opposite side to the second flow path plate and in which a plurality of third through holes having a constant shape are formed, a fourth flow path plate which is stacked on a plate surface of the third flow path plate on the opposite side to the second seal plate and in which a plurality of fourth through holes having the same constant shape as the third through holes are formed, and a third seal plate stacked on a plate surface of the fourth flow path plate on the opposite side to the third flow path plate. Preferably, in the third flow path plate, the third through holes are arranged so as to line up in a constant arrangement pattern in a second direction in which the second flow path allows the second fluid to flow, and in the fourth flow path plate, the fourth through holes are arranged so as to line up in the same constant arrangement pattern as the third through holes in the second direction, each of the third through holes has regions overlapping with the fourth through holes located on both sides of the third through hole in the second direction, and the second flow path is formed by the third through holes and the fourth through holes being alternately connected in the second direction in the regions where those through holes overlap.

In this configuration, the third through holes and the fourth through holes forming the second flow path are formed in the third flow path plate and the fourth flow path plate so as to have the same constant shape and are arranged so as to line up in the same constant arrangement pattern. Therefore, the internal structure of the stacking block is simplified. As a result, the internal structure of the stacked heat exchanger can be simplified, and the production cost of the heat exchanger can be reduced.

In this case, the respective third through holes and the respective fourth through holes are preferably circular through holes.

According to this configuration, the shape of the respective third through holes and the respective fourth through holes can be simplified compared to the case where the respective third through holes and the respective forth through holes are through holes having a complicated shape such as polygon or the like. As a result, the internal structure of the heat exchanger can be further simplified.

In the configuration in which the second flow path is formed by the third through holes and the fourth through holes being alternately connected, viewed from the stacking direction of the third flow path plate and the fourth flow path plate, the respective third through holes and the respective fourth through holes connected to the third through holes preferably overlap with a deviation to each other in the direction orthogonal to the second direction.

According to this configuration, by the third through holes and the fourth through holes, such a second flow path that the second fluid flows in the second direction while moving not only in the stacking direction of the third flow path plate and the fourth flow path plate but also in the direction orthogonal to the second direction can be formed. Therefore, the residence time of the second fluid in the second flow path can be extended. As a result, heat exchange between the first fluid and the second fluid can be facilitated.

In this case, preferably, the plurality of third through holes formed in the third flow path plate line up along a plurality of third lines extending in the second direction, the plurality of fourth through holes formed in the fourth flow path plate line up along a plurality of fourth lines extending in the second direction and corresponding to the plurality of third lines, the third through holes of each of the third lines and the fourth through holes of the corresponding fourth line overlap with a deviation to each other in both the second direction and the direction orthogonal to the second direction, and the third through holes of each of the third lines overlap with the fourth through holes of the adjacent fourth line in the direction orthogonal to the second direction with a deviation to each other.

According to this configuration, the second flow paths adjacent to each other are communicated in the region where the third through holes of the third line and the fourth through holes of the fourth line adjacent to each other in the direction orthogonal to the second direction overlap. Therefore, the second fluid flowing through each of the second flow paths flows to the downstream side while moving also to the next second flow path. Therefore, the residence time of the second fluid within the heat exchanger can be further extended. As a result, heat exchange between the first fluid and the second fluid can be further facilitated.

In the configuration in which the stacking block has the third flow path plate, the fourth flow path plate and the third seal plate, preferably, each of the third through holes consists of a third through hole one end part formed in a plate surface of the third flow path plate on the opposite side to the second seal plate, a third through hole other end part formed in a plate surface of the third flow path plate on the second seal plate side, and a third through hole intermediate part which is a portion between the third through hole one end part and the third through hole other end part of the third through hole, the third through hole other end part has a diameter smaller than the diameter of the third through hole one end part, and the third through hole intermediate part is formed so that the diameter thereof is not less than the diameter of the third through hole other end part and not more than the diameter of the third through hole one end part. Preferably, each of the fourth through holes consists of a fourth through hole one end part formed in a plate surface of the fourth flow path plate on the third flow path plate side, a fourth through hole other end part formed in a plate surface of the fourth flow path plate on the third seal plate side, and a fourth through hole intermediate part which is a portion between the fourth through hole one end part and the fourth through hole other end part of the fourth through hole, the fourth through hole other end part has a diameter smaller than the diameter of the fourth through hole one end part, and the fourth through hole intermediate part is formed so that the diameter thereof is not less than the diameter of the fourth through hole other end part and not more than the diameter of the fourth through hole one end part.

In this configuration, the third through hole other end part has a diameter smaller than the diameter of the third through hole one end part, and the third through hole intermediate part is formed so that the diameter thereof is not less than the diameter of the third through hole other end part and not more than the diameter of the third through hole one end part, and further, the fourth through hole other end part has a diameter smaller than the diameter of the fourth through hole one end part, and the fourth through hole intermediate part is formed so that the diameter thereof is not less than the diameter of the fourth through hole other end part and not more than the diameter of the fourth through hole one end part, thereby the change in the cross sectional area of the second flow path in the portion from the end part on the downstream side of the third through hole to the end part on the upstream side of the fourth through hole connected thereto and the portion from the end part on the downstream side of the fourth through hole to the end part on the upstream side of the third through hole connected thereto can be moderated. As a result, in the end part on the downstream side and the end part on the upstream side of the third through hole and the end part on the downstream side and the end part on the upstream side of the fourth through hole, generation of a vortex of the second fluid due to a rapid change in the flow path cross sectional area can be suppressed. As a result, the increase in resistance due to vortex of the second fluid is suppressed and the pressure loss of the second flow path can be reduced.

Moreover, in the configuration in which the stacking block has the third flow path plate, the fourth flow path plate and the third seal plate, preferably, the inner peripheral surface of the third flow path plate surrounding each of the third through holes has a third tapered surface part formed in a tapered shape toward the inside of the third through hole as it approaches to the second seal plate side from the plate surface of the third flow path plate on the opposite side to the second seal plate, and the inner peripheral surface of the fourth flow path plate surrounding each of the fourth through holes has a fourth tapered surface part formed in a tapered shape toward the inside of the fourth through hole as it approaches to the third seal plate side from the plate surface of the fourth flow path plate on the third flow path plate side.

In this configuration, the inner peripheral surface surrounding each of the third through holes has the third tapered surface part formed in the tapered shape described above, and the inner peripheral surface surrounding each of the fourth through holes has the fourth tapered surface part formed in the tapered shape described above, thereby the change in the cross sectional area of the second flow path in the portion from the end part on the downstream side of the third through hole to the end part on the upstream side of the fourth through hole connected thereto and the portion from the end part on the downstream side of the fourth through hole to the end part on the upstream side of the third through hole connected thereto can be moderated. As a result, in the end part on the downstream side and the end part on the upstream side of the third through hole and the end part on the downstream side and the end part on the upstream side of the fourth through hole, generation of a vortex of the second fluid due to a rapid change in the flow path cross sectional area can be suppressed. As a result, the increase in resistance due to vortex of the second fluid is suppressed and the pressure loss of the second flow path can be reduced.

In the configuration in which the second flow path is formed by the third through holes and the fourth through holes being alternately connected in the second direction, preferably, within the stacking block, a plurality of the second flow paths through which the second fluid flows in turn are arranged in parallel in the direction orthogonal to the second direction, and on both side surfaces of the stacking block in the second direction, the corresponding respective end parts of the respective second flow paths are formed respectively so as to be opened, and circulation headers that communicate the end part corresponding to an outlet of the second flow path on the upstream side and the end part corresponding to an inlet of the second flow path on the downstream side and direct the second fluid discharged from the outlet of the second flow path on the upstream side to the inlet of the second flow path on the downstream side are attached respectively.

According to this configuration, the second fluid flowed through the second flow path on the upstream side can be allowed to flow through the second flow path on the downstream side by reversing the direction of the flow thereof by means of the respective circulation headers on the outside of the stacking block. Therefore, the structure in which the whole heat exchanger can allow the second fluid to flow meanderingly so that the direction of the flow of the second fluid is alternately reversed in the second direction can be configured, while arranging the third through holes and the fourth through holes in the third flow path plate and the fourth flow path plate so as to line up linearly in the second direction. Accordingly, in this configuration, by circulating the second fluid so as to largely meander in the surface direction of the third flow path plate and the fourth flow path plate while preventing the arrangement of the third through holes and the fourth through holes from being complicated, the residence time of the second fluid can be further extended, and heat exchange between the first fluid and the second fluid can be further facilitated.

A production method of the heat exchanger according to the above embodiment is a method for producing a heat exchanger that allows at least a first fluid and a second fluid to exchange heat therebetween while allowing those fluids to circulate, the method being provided with a stacking block forming step for forming a stacking block having therein a first flow path that allows the first fluid to circulate and a second flow path that allows the second fluid to flow circulate, in which the stacking block forming step includes a first flow path forming step for forming the first flow path in the stacking block, and a second flow path forming step for forming the second flow path in the stacking block, the first flow path forming step has: a first through hole forming step for forming a plurality of first through holes having a constant shape in a first flow path plate so as to line up in a constant arrangement pattern in a first direction in which the first flow path allows the first fluid to flow; a second through hole forming step for forming a plurality of second through holes having the same constant shape as the first through holes in a second flow path plate so as to line up in the same constant arrangement pattern as the arrangement pattern of the first through holes; and a first stacking step for stacking the second flow path plate to the first flow path plate, and for stacking a first seal plate to a plate surface of the first flow path plate on the opposite side to the second flow path plate so as to seal the openings of the plurality of first through holes formed in the plate surface, and stacking a second seal plate to a plate surface of the second flow path plate on the opposite side to the first flow path plate so as to seal the openings of the plurality of second through holes formed in the plate surface, and in the first stacking step, the second flow path plate is stacked to the first flow path plate so that each of the first through holes partially overlaps with the second through holes located on both sides of the first through holes in the first direction, and the first flow path is formed by the first through holes and the second through holes being alternately connected in the first direction in the regions where those through holes overlap.

In the production method of the heat exchanger, since the internal structure of the stacking block with respect to the first through holes and the second through holes can be simplified, the effects similar to the above heat exchanger in that the internal structure of the stacked heat exchanger can be simplified and the production cost of the heat exchanger can be reduced can be obtained. Moreover, in the production method of the heat exchanger, the first through hole forming step and the second through hole can be simplified, and as a result, the production steps of the heat exchanger can be simplified.

In the production method of the above heat exchanger, preferably, at the first through hole forming step, the respective first through holes are formed in the first flow path plate by a punching process with blanking pins, and at the second through hole forming step, the respective second through holes are formed in the second flow path plate by a punching process with blanking pins.

According to this configuration, compared to the conventional production method of the heat exchanger in which the through holes are formed by an etching processing or a laser processing, the first through holes and the second through holes can be easily formed, and the processing cost of those through holes can be reduced.

In the production method of the above heat exchanger, preferably; the second flow path forming step has: a third through hole forming step for forming a plurality of third through holes having a constant shape in a third flow path plate so as to line up in a constant arrangement pattern in a second direction in which the second flow path allows the second fluid to flow; a fourth through hole forming step for forming a plurality of fourth through holes having the same constant shape as the third through holes in a fourth flow path plate so as to line up in the same constant arrangement pattern as the arrangement pattern of the third through holes; and a second stacking step for stacking the fourth flow path plate to the third flow path plate, and for stacking the third flow path plate to the second seal plate so as to seal the openings of the plurality of third through holes formed in the plate surface of the third flow path plate on the opposite side to the fourth flow path plate by the plate surface of the second seal plate on the opposite side to the second flow path plate, and stacking a third seal plate to a plate surface of the fourth flow path plate on the opposite side to the third flow path plate so as to seal the openings of the plurality of fourth through holes formed in the plate surface, and in the second stacking step, the third flow path plate is stacked to the third flow path plate so that each of the third through holes partially overlaps with the fourth through holes located on both sides of the third through holes in the second direction, and the second flow path is formed by the third through holes and the fourth through holes being alternately connected in the second direction in the regions where those through holes overlap.

In this configuration, since the internal structure of the stacking block with respect to the third through holes and the fourth through holes can be simplified, the internal structure of the stacked heat exchanger can be simplified and the production cost of the heat exchanger can be reduced. Moreover, in the production method of the heat exchanger, the third through hole forming step and the fourth through hole can be simplified, and as a result, the production steps of the heat exchanger can be simplified.

In this case, preferably, at the third through hole forming step, the respective third through holes are formed in the third flow path plate by a punching process with blanking pins, and at the fourth through hole forming step, the respective fourth through holes are formed in the fourth flow path plate by a punching process with blanking pins.

According to this configuration, compared to the conventional production method of the heat exchanger in which the through holes are formed by an etching processing or a laser processing, the third through holes and the fourth through holes can be easily formed, and the processing cost of those through holes can be reduced.

As described above, according to the embodiment, the internal structure of the stacked heat exchanger can be simplified and the production cost can be reduced.

The invention claimed is:

1. A heat exchanger that allows at least a first fluid and a second fluid circulating therein to exchange heat therebetween, the heat exchanger comprising a stacking block having therein a first flow path for the first fluid and a second flow path for the second fluid, wherein the stacking block comprises: a first plate having a first plate first surface and a first plate second surface, a second plate having a second plate first surface and a second plate second surface, the first plate stacked on the second plate; the first plate formed with a plurality of first through holes having mutually identical shapes; the second plate formed with a plurality of second through holes having mutually identical shapes, the mutually identical shapes of the second through holes being identical to the mutually identical shapes of the first through holes; a first seal plate stacked on the first plate first surface; and a second seal plate stacked on the second plate second surface, wherein the first plate first surface faces away from the second plate and the second plate second surface faces away from the first plate, wherein in the first plate, the first through holes are mutually aligned and equally spaced in a first direction, wherein in the second plate, the second through holes are mutually aligned and equally spaced in the first direction, wherein each of the first through holes has regions overlapping with the second through holes on both sides of the first through hole in the first direction, and the first flow path is formed by the first through holes and the second through holes being alternately connected in the first direction in the regions where first and second holes overlap; wherein each of the first through holes consists of a first through hole one end part formed in the first plate second surface, a first through hole other end part formed in the first plate first surface, and a first through hole intermediate part which is a portion between the first through hole one end part and the first through hole other end part of the first through hole, wherein the first through hole other end part has a diameter smaller than the diameter of the first through hole one end part, wherein the first through hole intermediate part is formed so that the diameter thereof is not less than the diameter of the first through hole other end part and not more than the diameter of the first through hole one end part; wherein each of the second through holes consists of a second through hole one end part formed in the second plate first surface, a second through hole other end part formed in the second plate second surface, and a second through hole intermediate part which is a portion between the second through hole one end part and the second through hole other end part of the second through hole; wherein the second through hole other end part has a diameter smaller than the diameter of the second through hole one end part, and wherein the second through hole intermediate part is formed so that the diameter thereof is not less than the diameter of the second through hole other end part and not more than the diameter of the second through hole one end part.

2. The heat exchanger according to claim 1, wherein the first through holes and the second through holes are circular.

3. The heat exchanger according to claim 1, wherein each of the first through holes is defined by an inner peripheral surface of the first plate, the inner peripheral surfaces of the first plate comprising a tapered shape; and wherein each of the second through holes is defined by an inner peripheral surface of the second plate, the inner peripheral surfaces of the second plate comprising a tapered shape.

4. The heat exchanger according to claim 1, wherein the stacking block comprises a third plate having a third plate first surface and a third plate second surface, and a fourth plate having a fourth plate first surface and a fourth plate second surface, the third plate stacked on the fourth plate; the third plate formed with a plurality of third through holes having mutually identical shapes, the fourth plate formed with a plurality of fourth through holes having mutually identical shapes, the mutually identical shapes of the fourth through holes being identical to the mutually identical shapes of the third through holes; wherein the second seal plate is stacked on the third plate first surface, the third plate first surface contacting a surface of the second seal plate which is opposite to the surface of the second seal plate contacting the second plate second surface, and a third seal plate stacked on the fourth plate second surface, wherein the third plate first surface faces away from the fourth plate and the fourth plate second surface faces away from the third plate; wherein in the third plate, the third through holes are mutually aligned and equally spaced in a second direction, wherein in the fourth plate, the fourth through holes are mutually aligned and equally spaced in the second direction, wherein each of the third through holes has regions overlapping with the fourth through holes on both sides of the third through hole in the second direction, and the second flow path is formed by the third through holes and the fourth through holes being alternately connected in the second direction in the regions where the third and fourth holes overlap; wherein each of the third through holes consists of a third through hole one end part formed in the third plate second surface, a third through hole other end part formed in the third plate first surface, and a third through hole intermediate part which is a portion between the third through hole one end part and the third through hole other end part of the third through hole, wherein the third through hole other end part has a diameter smaller than the diameter of the third through hole one end part, wherein the third through hole intermediate part is formed so that the diameter thereof is not less than the diameter of the third through hole other end part and not more than the diameter of the third through hole one end part; wherein each of the fourth through holes consists of a fourth through hole one end part formed in the fourth plate first surface, a fourth through hole other end part formed in the fourth plate second surface, and a fourth through hole intermediate part which is a portion between the fourth through hole one end part and the fourth through hole other end part of the fourth through hole, wherein the fourth through hole other end part has a diameter smaller than the diameter of the fourth through hole one end part, and wherein the fourth through hole intermediate part is formed so that the diameter thereof is not less than the diameter of the fourth through hole other end part and not more than the diameter of the fourth through hole one end part.

5. The heat exchanger according to claim 4, wherein the third through holes and the fourth through holes are circular.

6. The heat exchanger according to claim 4, wherein each of the third through holes is defined by an inner peripheral surface of the third plate, the inner peripheral surfaces of the third plate comprising a tapered shape; and wherein each of the fourth through holes is defined by an inner peripheral surface of the fourth plate, the inner peripheral surfaces of the fourth plate comprising a tapered shape.

7. The heat exchanger according to claim 4, wherein within the stacking block, the second flow path is one of a plurality of second flow paths through which the second fluid flows, and wherein on two opposite side surfaces of the stacking block in the second direction, end parts of the second flow paths are formed so as to be open, and circulation headers attached to the opposite side surfaces, the circulation headers communicating outlets of the second flow paths to inlets of the second flow paths.

* * * * *